US008939847B2

(12) United States Patent
Sander et al.

(10) Patent No.: US 8,939,847 B2
(45) Date of Patent: Jan. 27, 2015

(54) GOLF CLUBS AND GOLF CLUB HEADS INCLUDING STRUCTURE TO SELECTIVELY ADJUST THE FACE AND LIE ANGLE OF THE CLUB HEAD

(75) Inventors: Raymond J. Sander, Benbrook, TX (US); Robert Boyd, Flower Mound, TX (US)

(73) Assignee: Nike, Inc., Beaverton, OR (US)

( * ) Notice: Subject to any disclaimer, the term of this patent is extended or adjusted under 35 U.S.C. 154(b) by 215 days.

(21) Appl. No.: 13/484,972

(22) Filed: May 31, 2012

(65) Prior Publication Data

US 2013/0324286 A1 Dec. 5, 2013

(51) Int. Cl.
*A63B 53/02* (2006.01)

(52) U.S. Cl.
USPC ..... 473/307; 473/309; 473/246

(58) Field of Classification Search
USPC ..... 473/244–248, 288, 307, 309
See application file for complete search history.

(56) References Cited

U.S. PATENT DOCUMENTS 2,027,452 A * 1/1936 Rusing ..... 473/246
3,840,231 A * 10/1974 Moore ..... 473/245
5,133,553 A * 7/1992 Divnick ..... 473/245
8,376,874 B2 * 2/2013 Bennett et al. ..... 473/288
8,403,770 B1 * 3/2013 Aguinaldo et al. ..... 473/307
8,523,701 B2 * 9/2013 Knutson et al. ..... 473/307
8,622,848 B2 * 1/2014 Bennett et al. ..... 473/307
8,696,486 B1 * 4/2014 Aguinaldo et al. ..... 473/307
2009/0286619 A1 * 11/2009 Beach et al. ..... 473/324
2010/0197424 A1 * 8/2010 Beach et al. ..... 473/307
2011/0105242 A1 * 5/2011 Beach et al. ..... 473/307
2012/0034996 A1 * 2/2012 Murphy et al. ..... 473/307
2012/0165111 A1 * 6/2012 Cheng ..... 473/305
2012/0295733 A1 * 11/2012 Bennett et al. ..... 473/307
2013/0244805 A1 * 9/2013 Bolane et al. ..... 473/307
2013/0344981 A1 * 12/2013 Knutson et al. ..... 473/307

* cited by examiner

*Primary Examiner* — Stephen L. Blau
(74) *Attorney, Agent, or Firm* — Banner & Witcoff, Ltd.

(57) ABSTRACT

Aspects of this invention relate to structures and methods for connecting golf club heads to shafts in a releasable and adjustable manner allowing independent adjustability of face angle, loft angle, and lie angle of a club head. Assemblies for connecting the club head and shaft may include: (a) a hosel assembly; (b) an adjustment member; and (c) a securing system for releasably and adjustably securing the hosel assembly and adjustment member to the club head. The face angle, loft angle, and lie angle may be independently adjusted by releasing the securing system and rotating the different structures or exchanging the original parts with different parts.

20 Claims, 20 Drawing Sheets

Neutral Lie Angle

-2° Offset Lie Angle

+2° Offset Lie Angle

GOLF CLUBS AND GOLF CLUB HEADS INCLUDING STRUCTURE TO SELECTIVELY ADJUST THE FACE AND LIE ANGLE OF THE CLUB HEAD

FIELD OF THE INVENTION

This invention relates generally to golf clubs and golf club heads. More particularly, aspects of this invention relate to golf clubs having adjustable and releasable connections between the golf club head and the shaft and head/shaft position adjusting features to allow easy adjustment of shafts and heads and to allow easy modification of the club head properties.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc.). Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable and adjustable manner allowing independent adjustability of face angle, loft angle, and lie angle of a club head. Golf club head/shaft connection assemblies or golf clubs in accordance with examples of this invention may include: (a) a hosel assembly including a first end a second end opposite the first end, the first end including an open first end that defines an interior chamber for receiving a golf club shaft, and the second end including a cylindrical inner surface that defines a rotation inhibiting structure; (b) an adjustment member in the shape of a generally cylindrical ring, the adjustment member defines an exterior surface with an exterior rotation-inhibiting structure and an interior surface with an interior rotation-inhibiting structure, wherein the interior rotation inhibiting structure cooperatively engages with the rotation-inhibiting structure on the hosel assembly, and further wherein changing the rotational position of the adjustment member with respect to the hosel assembly provides independent adjustment of a face angle of a golf club head; (c) one or more sleeve inserts that includes an exterior portion generally cylindrical in shape and capable of fitting into and engaging the interior of a club head chamber, and further includes an interior portion generally cylindrical in shape and capable of accepting and engaging the hosel assembly and the adjustment member, wherein the one or more sleeve inserts are configured to adjust the location of the hosel assembly within a club head chamber, thereby providing independent adjustment of a lie angle of a golf club head; and (d) a securing system for releasably securing the adjustment member and one of the one or more sleeve inserts with the hosel assembly. The hosel assembly and the club head may be unsecured with respect to one another by releasing the securing system. Once unsecured, the adjustment member may then be dialed or rotated to a desired setting to independently adjust the face angle of the club head. Furthermore, a sleeve insert (with different cylindrical characteristics) may be interchanged with the original sleeve insert so as to allow the independent adjustment of the lie angle of the club head.

Another golf club head/shaft connection assemblies or golf club capable of independent adjustability of face angle and lie angle and in accordance with examples of this invention may include: (a) a hosel assembly including a first end and a second end opposite the first end, the first end including an open first end that defines an interior chamber for receiving a golf club shaft, and the second end including a cylindrical inner surface that defines a rotation inhibiting structure; (b) an adjustment member in the shape of a generally cylindrical ring, the adjustment member defines an exterior surface with an exterior rotation-inhibiting structure and an interior surface with an interior rotation-inhibiting structure, wherein the interior rotation inhibiting structure cooperatively engages with the rotation-inhibiting structure on the hosel assembly, and further wherein changing the rotational position of the adjustment member with respect to the hosel assembly provides independent adjustment of a face angle of a golf club head; (c) a pair of angled washers in the shape of a circular washer that include a first angled washer and a second angled washer when engaged together correspond to one of three lie angle washer positions defined as a neutral lie angle position, a upright lie angle position, and a flat lie angle position, thereby providing independent adjustment of a lie angle of a golf club head; and (d) a securing system for releasably securing the adjustment member and the pair of angled washers with the hosel assembly. The hosel assembly and the club head may be unsecured with respect to one another by releasing the securing system. Once unsecured, the adjustment member may then be dialed or rotated to a desired setting to independent adjust the face angle of the club head. Furthermore, the pair of angled washers may be may be engaged in a different position from the original position so as to allow the independent adjustment of the lie angle of the club head.

Another golf club head/shaft connection assemblies or golf club capable of independent adjustability of face angle and lie angle and in accordance with examples of this invention may include: (a) a hosel assembly that includes, (1) a shaft engagement section including a cylindrical chamber, a shaft adapter sized to fit within and engage an interior of the cylindrical chamber, and a securing nut that includes threads on an interior of the securing member to engage a threaded end on the shaft engagement section and secure the shaft adapter and a shaft to the shaft engagement section, wherein the shaft adapter includes a shaft chamber for receiving a golf club shaft, and (2) a club head engagement section sized and shaped to cooperatively fit against a rear portion of a club head, wherein the club head engagement section defines an opening and adjusting slots; (b) an adjustment member generally cylindrical in shape and sized to fit through the opening of the club head engagement section and cooperatively engage with the adjusting slots on the club head engagement section; and (c) a securing member for releasably securing the hosel assembly and the adjustment member with a club head body. The shaft adapter and the shaft engagement section may be unsecured with respect to one another by releasing the securing nut. Once unsecured, the shaft adapter may be rotated within the shaft engagement section, thus allowing the independent adjustment of the lie angle. Additionally, the adjustment member and the hosel assembly may be unsecured with respect to one another by releasing the securing member. Once unsecured, the adjustment member may then be rotated to a desired setting, thus rotating the hosel assembly with respect to the club head, and allowing the independent adjustment of the face angle of the club head.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to systems and methods for connecting golf club heads to shafts in a releasable and adjustable manner allowing the independent adjustability of the face angle and lie angle of a golf club head. More detailed descriptions of aspects of this invention follow.

Figure 1:
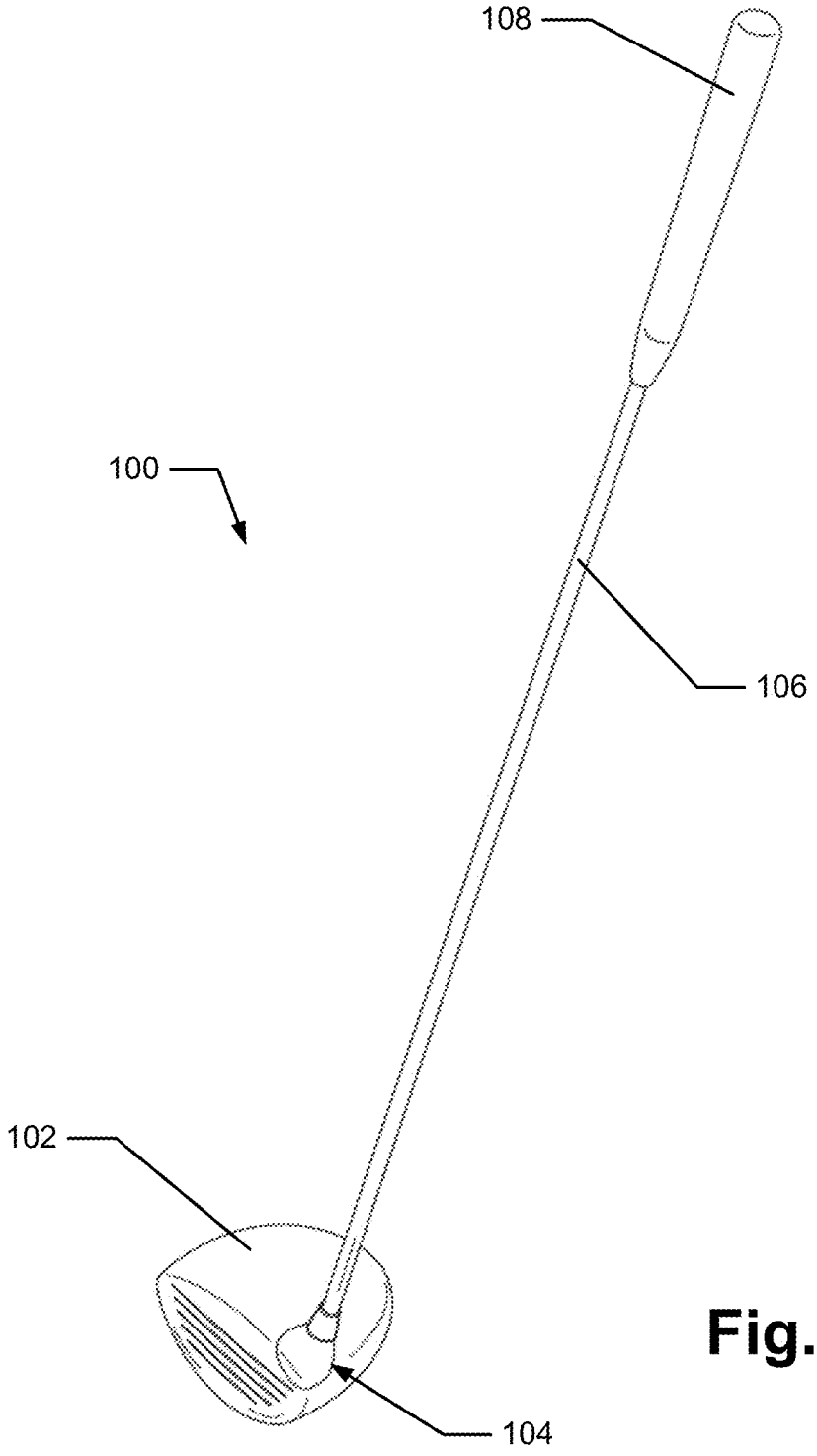
FIG. 1 generally illustrates a perspective front view of an example golf club according to this invention.

FIG. 1 generally illustrates an example golf club 100 in accordance with at least some examples of this invention. This club 100 includes a club head 102, an adjustable club head/shaft connection region 104 that connects the club head 102 to a shaft 106 (which will be described in more detail below), and a grip member 108 engaged with the shaft 106. While a driver/wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from conventional materials, in conventional constructions, in conventional manners, as are known and used in the art, optionally modified (if necessary, e.g., in size, shape, etc.) to accommodate the releasable club head/shaft connection parts.

Any desired materials also may be used for the shaft member 106, including conventional materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 108 may be engaged with the shaft 106 in any desired manner, including in conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc.

Figure 2A:
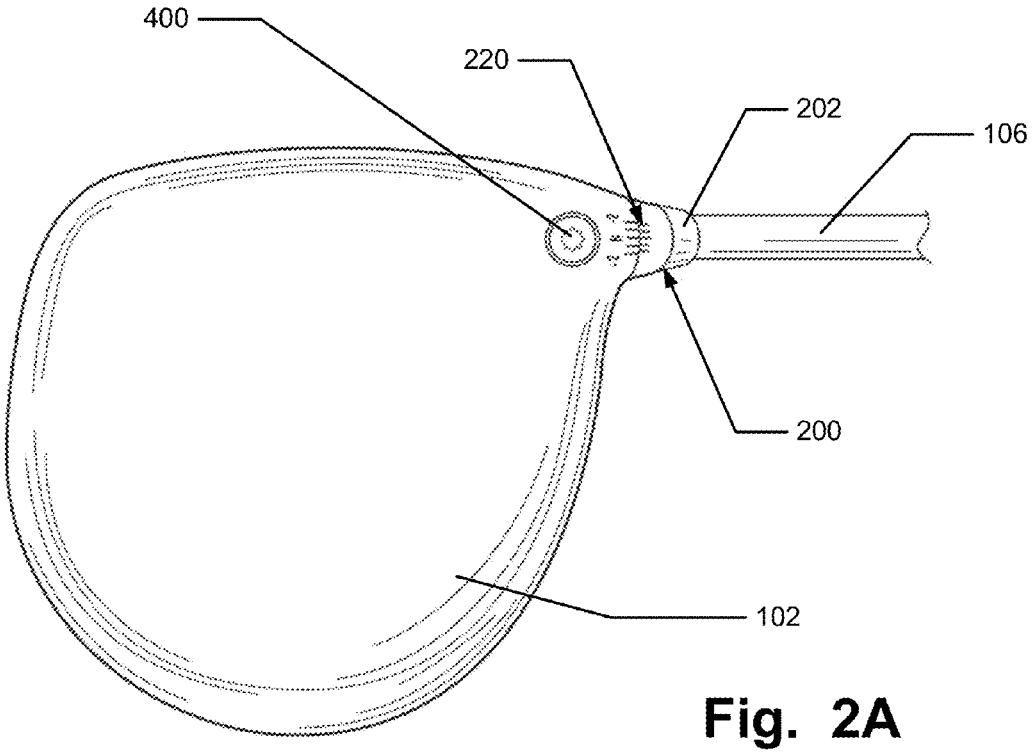
FIGS. 2A and 2B illustrate bottom views of the example golf club head illustrated in FIG. 1 in accordance with this invention in both a full view (FIG. 2A) and a close-up view of an example connection assembly (FIG. 2B)
Figure 2B:
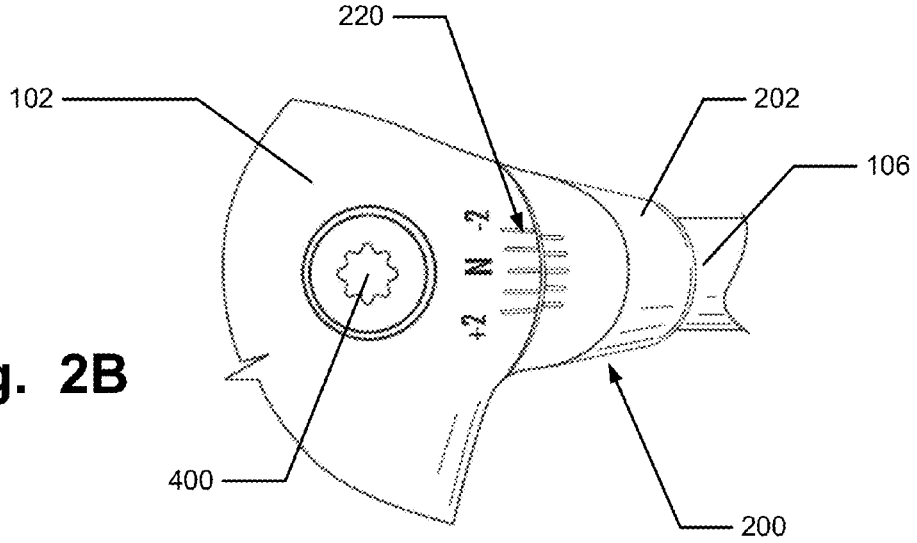
Figure 3:
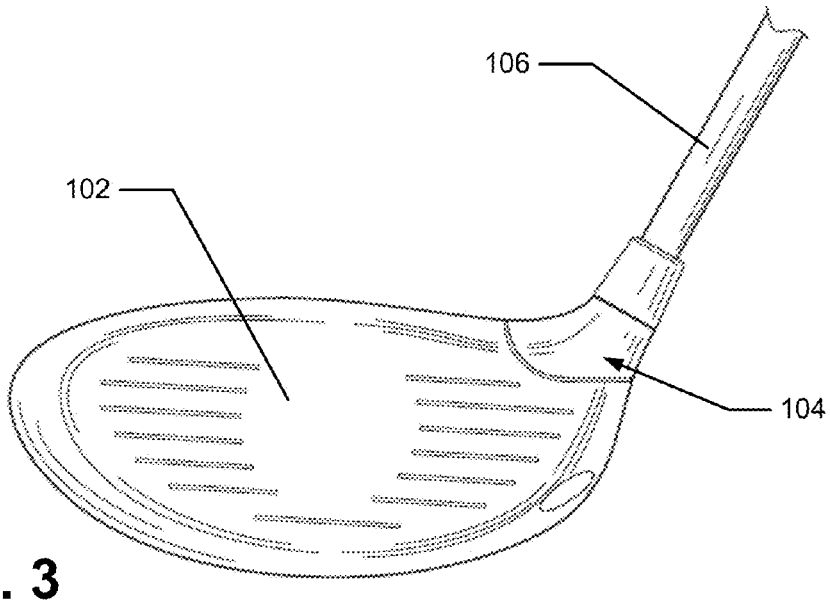
FIG. 3 illustrates an assembled front view of the example golf club head illustrated in FIG. 1 in accordance with this invention.
Figure 4:
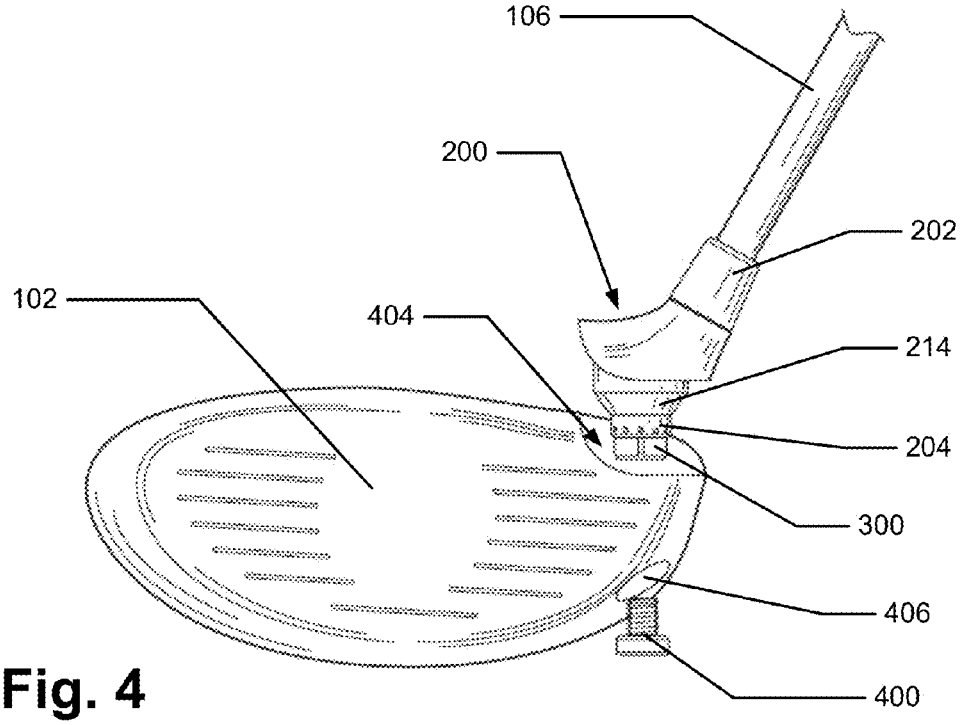
FIG. 4 illustrates an exploded front view of the example golf club head illustrated in FIG. 1 in accordance with this invention.
Figure 5:
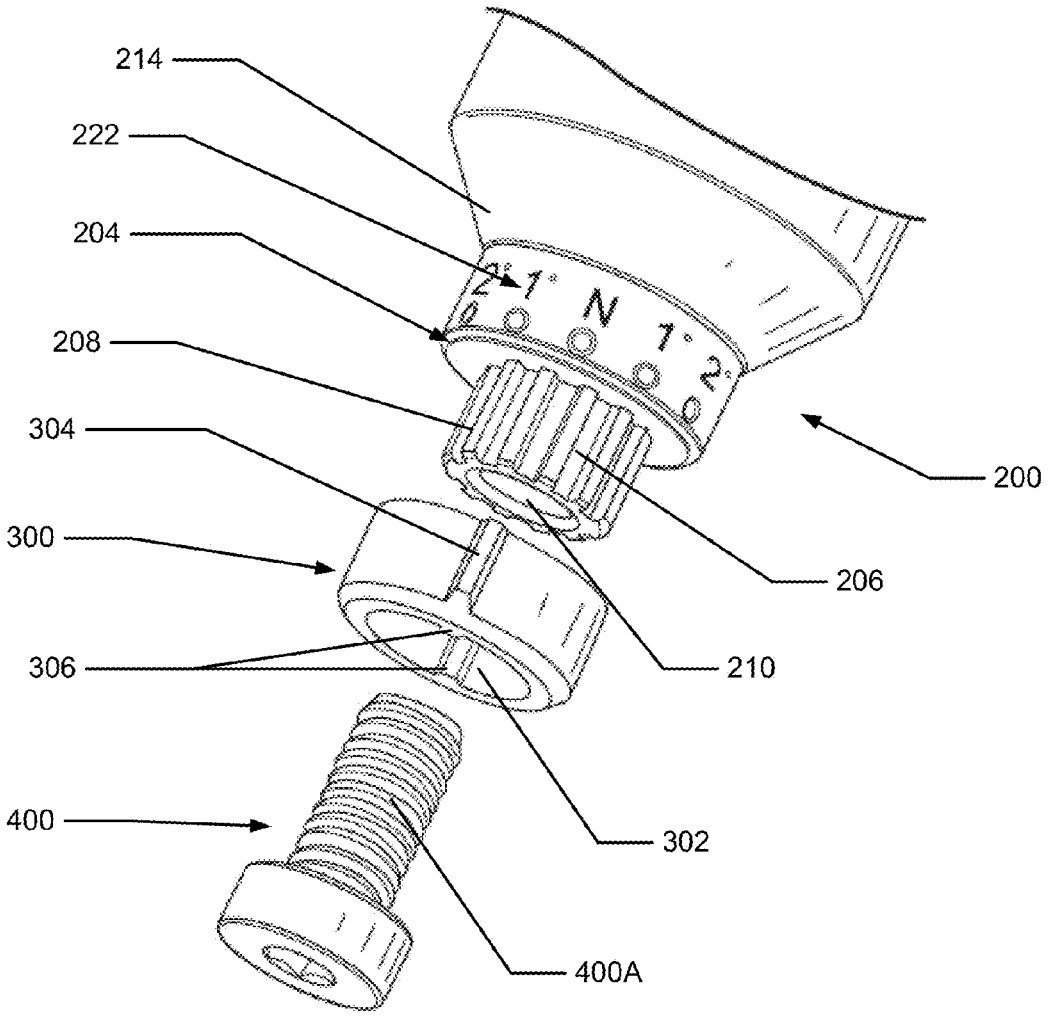
FIG. 5 illustrates a close-up exploded perspective view of the connection assembly of the example golf club head illustrated in FIG. 1 in accordance with this invention.
Figure 6:
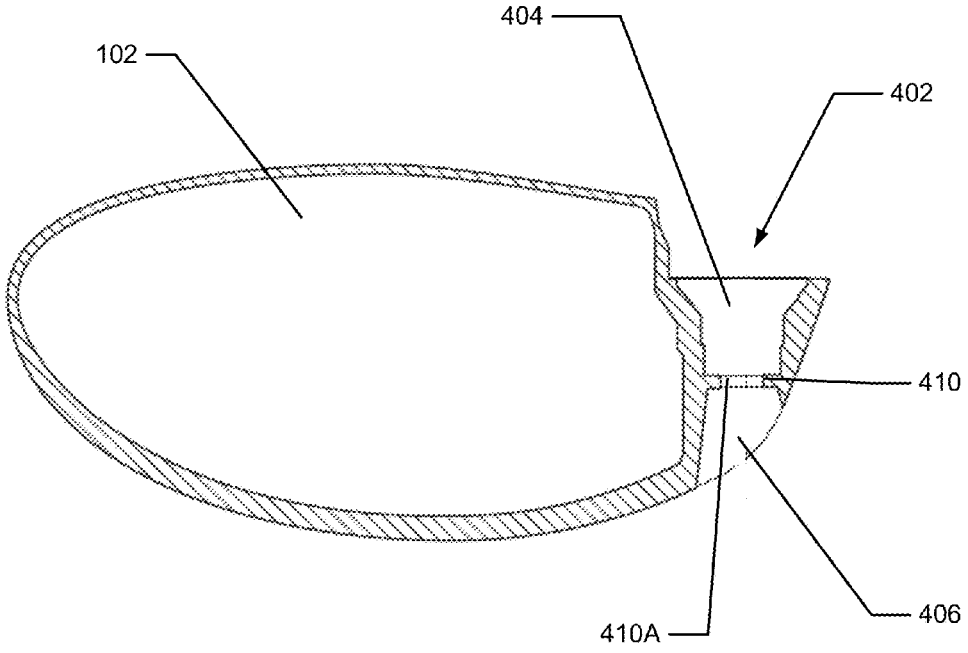
FIG. 6 illustrates a sectional view of the example golf club head illustrated in FIG. 1 in accordance with this invention.
Figure 7:
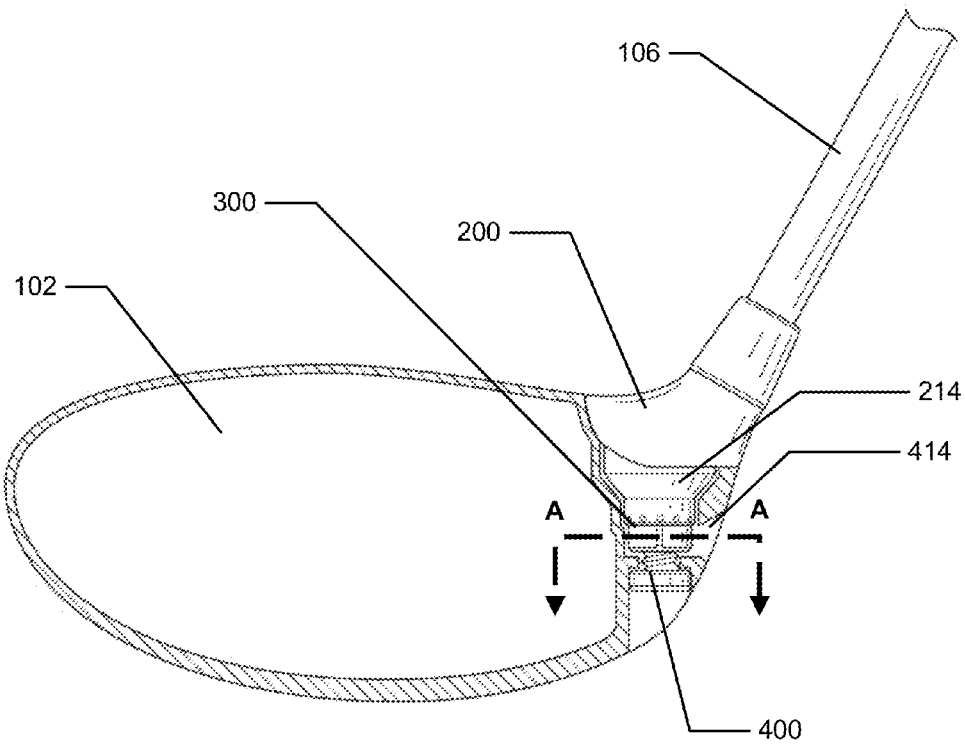
FIG. 7 illustrates a sectional view of the example golf club head illustrated in FIG. 1 with the connection assembly in accordance with this invention.
Figure 8A:
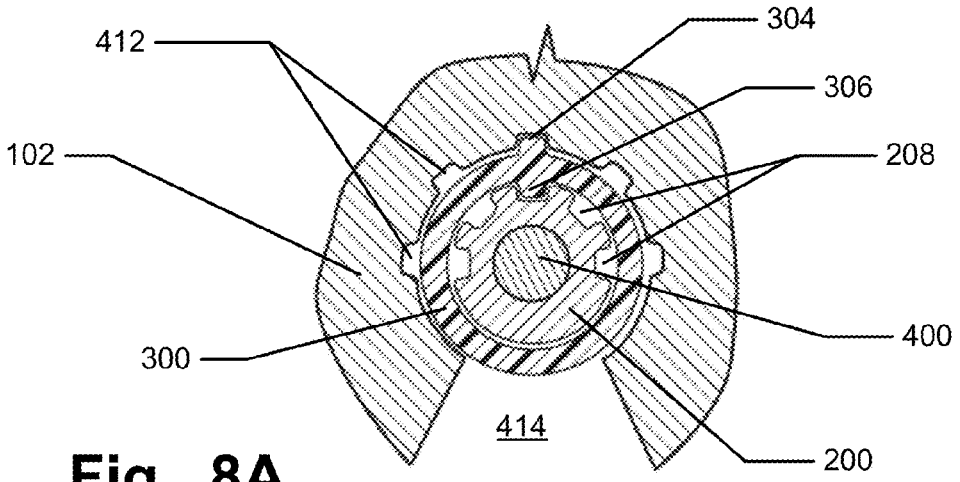
FIGS. 8A through 8C illustrate cross-sectional views of the example connection assembly illustrated in FIG. 7 along section A-A in accordance with this invention.
Figure 8B:
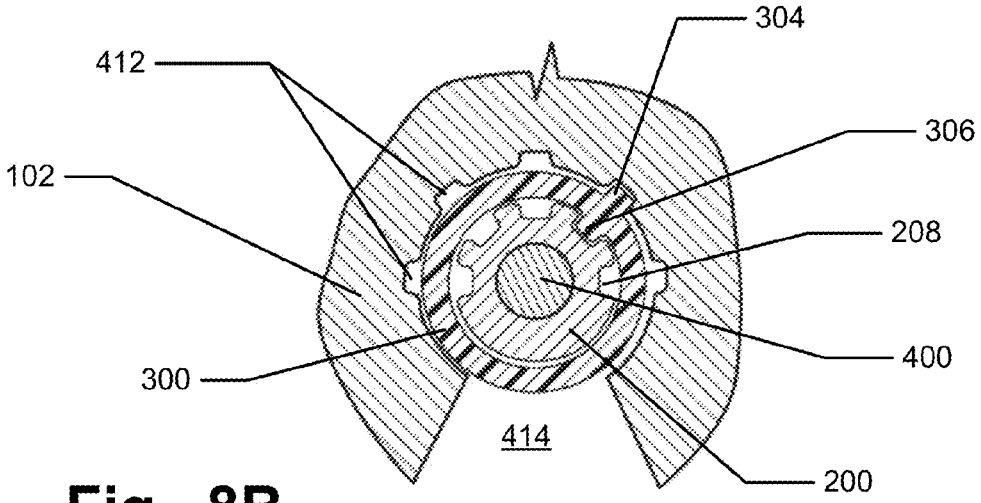
Figure 8C:
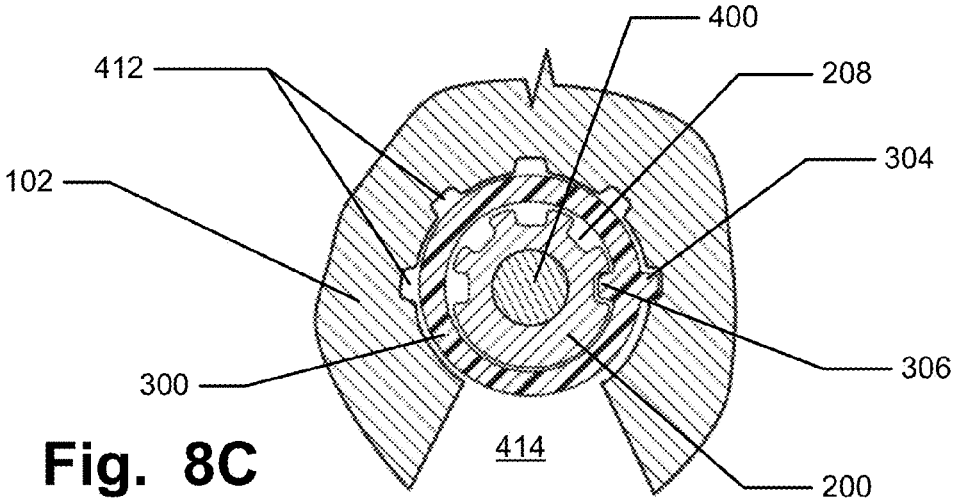

The adjustable connection 104 between golf club heads and shafts in accordance with some examples of this invention now will be described in more detail in conjunction with FIGS. 2A through 8C. FIGS. 2A and 2B illustrate bottom views of the example golf club head in both a full view (FIG. 2A) and a close-up view of an example connection assembly. FIG. 3 illustrates an assembled front view of the example golf club head. FIG. 4 illustrates an exploded front view of the example golf club head. FIG. 5 illustrates a close-up exploded perspective view of the connection assembly of the example golf club head. FIG. 6 illustrates a sectional view of the example golf club head. FIG. 7 illustrates a sectional view of the example golf club head and the connection assembly. FIGS. 8A through 8C illustrate cross-sectional views of the example connection assembly along section A-A. As shown in these figures, this example adjustable connection 104 includes three main parts, namely: a hosel assembly 200, an adjustment ring 300, and a securing member 400.

The hosel assembly 200 includes a first end 202 and a second end 204 opposite the first end 202. The first end 202 may include a cylindrical chamber (not shown) that may be sized to engage and fit over the shaft 106 and may be secured thereto in any desired manner, e.g., via cements or adhesives; via welding, brazing, soldering, or other fusing techniques; via mechanical connectors; via a friction fit; etc.

The second end 204 may include a cylindrical outer surface 206 that fits into the club head 102. The cylindrical outer surface 206 may include a rotation inhibiting structure 208 (such as teeth as illustrated in FIG. 5) configured to cooperatively engage with the adjustment ring 300, and a rotation-inhibiting structure 412 on an interior chamber 404 of the club head 102. Additionally, the second end 204 may include cylindrical inner surface 210 that engages and secures the securing member 400. The example illustrated in FIG. 5 includes a cylindrical inner surface 210 that includes threads to engage threads 400A on the securing member 400. Other releasable mechanical connection systems are possible without departing from this invention.

FIG. 5 further illustrates that the second end 204 of the hosel assembly 200 includes an expanded portion 214. As will be more apparent from FIG. 7, this expanded portion 214 provides a stop that prevents the hosel assembly 200 from extending into the club head body 102 and provides a strong base for securing the hosel assembly 200 and the club head body 102. Also, the exterior shape of the second end 204 may be tapered to provide a smooth transition between the hosel assembly 200 and the club head 102 and convey a conventional aesthetic appearance.

The hosel assembly 200 may be made from any desired materials and from any desired number of independent parts without departing from this invention. In this illustrated example, the entire hosel assembly 200 is made as a unitary, one-piece construction from conventional materials, such as metals or metal alloys, plastics, and the like. In at least some example structures according to this invention, the hosel assembly 200 will be made from a titanium, aluminum, magnesium, steel, or other metal or metal alloy material. The various holes (e.g., threaded hole 210) and/or surface structures (e.g., rotation-inhibiting structure 208) may be produced in the material in any desired manner without departing from the invention, including via production methods that are commonly known and used in the art, such as by drilling tapping, machining, lathing, extruding, grinding, casting, extruding, molding, etc.

The example releasable connection 104 may further include an adjustment ring 300. FIGS. 4 and 5 illustrate an example adjustment ring 300 in accordance with this invention. The adjustment ring 300 of this example structure 104 is in the shape of a generally cylindrical ring. The adjustment ring 300 may be other shapes without departing from this invention. For example, the adjustment ring 300 may be in the shape of an oval, rectangle, square, triangle, or other polygon shapes. The adjustment ring 300 defines an opening 302 for receiving the securing member 400. Generally, the opening 302 is sized such that the securing member 400 is able to freely pass through the opening 302 to engage the threaded hole 210 in the hosel assembly 200. Alternatively, the securing member may also engage the adjustment ring 300 at the opening 302 (e.g., the opening 302 may include threads that engage threads provided on the securing member 400).

As illustrated in FIG. 5, the adjustment ring 300 defines an exterior surface with an exterior rotation-inhibiting structure 304. The exterior rotation-inhibiting structure 304 may be in the form of a tooth or multiple teeth, as illustrated in FIG. 4. Other exterior rotation-inhibiting structures 304 are possible without departing from this invention, such as multiple teeth, splines, flat-sided cross sections, etc. While a variety of rotation-inhibiting structures may be provided without departing from this invention, the exterior rotation-inhibiting structure 304 constitutes a tooth extending along the longitudinal axis of the exterior surface of the adjustment ring 300. The exterior rotation-inhibiting structure 304 of the adjustment ring 300 may prevent rotation of the adjustment ring 300 with respect to a member into which it is fit (e.g., the golf club head and/or a sleeve insert, as will be explained more below). A variety of non-rounded cross-sectional structures may be used for the rotation-inhibiting structure without departing from this invention.

The adjustment ring 300 may also define an interior surface with an interior rotation-inhibiting structure 306. The interior rotation-inhibiting structure 306 may be in the form of a tooth or multiple teeth, as illustrated in FIG. 5. Other interior rotation-inhibiting structures 306 are possible without departing from this invention. While a variety of rotation-inhibiting structures may be provided without departing from this invention, the interior rotation-inhibiting structure 306 constitutes a tooth extending along the longitudinal axis of the interior surface of the adjustment ring 300. The interior rotation-inhibiting structure 306 of the adjustment ring 300 may prevent rotation of the adjustment ring 300 with respect to the second end 204 of the hosel assembly 200. The interior rotation-inhibiting structure 306 may be configured to cooperatively engage with the rotation-inhibiting structure 208 on the hosel assembly 200. A variety of non-rounded cross-sectional structures may be used for the rotation-inhibiting structure without departing from this invention.

The adjustment ring 300 may be made from any desired materials and from any desired number of independent parts without departing from this invention. In this illustrated example, the adjustment ring 300 is made as a unitary, one-piece construction from conventional materials, such as metals or metal alloys, plastics, and the like. In at least some example structures according to this invention, the hosel adjustment ring 300 will be made from a titanium, aluminum, magnesium, steel, or other metal or metal alloy material. The various holes (e.g., opening 302) and/or surface structures (e.g., external rotation-inhibiting structure 304 and internal rotation-inhibiting structure 306) may be produced in the material in any desired manner without departing from the invention, including via production methods that are commonly known and used in the art, such as by drilling tapping, machining, lathing, extruding, grinding, casting, extruding, molding, etc.

One example of engagement of a golf club shaft 106 with a club head 102 utilizing the hosel assembly 200 and the adjustment ring 300 will be described in more detail in conjunction with FIGS. 4 and 5. At some time during the head/shaft connection process, a shaft 106 is engaged within the cylindrical chamber of the hosel assembly 200. In this illustrated example structure, the shaft 106 will be permanently engaged in the chamber, e.g., via an adhesive or cement bond. Other ways of engaging a shaft 106 with the hosel assembly 200 are possible without departing from this invention, including, for example, mechanical connections (including releasable mechanical connections, such as threaded structures or the like); welding, brazing, soldering, or other fusing techniques; etc. Once the shaft 106 is connected to the hosel assembly 200, the hosel assembly 200 may be engaged with the adjustment ring 300 and mounted to the golf club head 102. Alternatively, if desired, the shaft 106 may be connected to the hosel assembly 200 later in the process, even as late as the final step in the connection process.

The example club head structure 102 now will be described in more detail, particularly as illustrated in FIGS. 6 and 7. In this example structure, the club head 102 includes a hosel area 402 that provides access to a club head chamber 404 defined in the club head 102. The club head chamber 404 in this example structure extends completely through the club head body 102 and defines an opening 406 at the sole or bottom of the club head 102. This opening 406 allows access for insertion of the securing member 400 (e.g., a threaded bolt member) that helps secure the hosel assembly 200 and adjustment ring 300 to the club head body 102, as will be described in more detail below. In this example structure, the club head chamber 404 includes a mounting plate 410 with a hole 410A defined therein, which provides a support surface for securing the hosel adapter 200 and the adjustment ring 300 within the club head body 102, as will be explained in more detail below. If desired, the mounting plate 410 may be integrally formed as part of the club head structure, and it may be located at any desired position along the club head chamber 404, including right at or near the opening 406. Additionally or alternatively, if desired, a plug member may be provided close to opening 406 (optionally a removable plug member) or the sole member may include a countersunk region to allow the bolt member 400 to lie flush or substantially flush with the club head sole.

Additionally or alternatively, the club head may 102 include a structure to engage and prevent rotation of the adjustment ring 300 within the club head 102 and more specifically, engaging the external rotation-inhibiting structure 304 on the adjustment ring 300. As illustrated in FIGS. 8A through 8C, the club head 102 may include rotation-inhibiting structures 412 that are sized and shaped to engage the external rotation-inhibiting structure 304 on the adjustment ring 300. For example, as specifically illustrated in FIGS. 8A through 8C, the external rotation-inhibiting structure 304 on the adjustment ring 300 is in the form of a tab or key which engages a slot or groove as the rotation-inhibiting structure 412 of the club head.

The adjustment of the rotational position of the hosel assembly 200 (and its attached shaft 106) will be explained in more detail below as illustrated in FIGS. 8A through 8C. Changing the rotational position of the shaft adapter 200 through the use of the adjustment ring 300 may adjust one of various features of the overall golf club, namely the face angle. To enable users to easily identify the club head's "settings" (e.g., the club head body 102 position and/or orientation with respect to the shaft 106), the hosel assembly 200 and/or the club head 102 may include markings or indicators. FIGS. 2A and 2B show an indicator 220 on the hosel assembly 200 and club head 102. FIG. 5 shows an indicator 222 on the second end 204 of the hosel assembly 200. By noting the relative positions of the various indicators, a club fitter or other user can readily determine and know the position of the shaft 106 with respect to the club head body 102 and its ball striking face. If desired, the indicators (e.g., indicators 220 or 222) may be associated with and/or include specific quantitative information, such as a specifically identified face angle (or other information such as loft angle, lie angle, inset distance, offset distance, etc.), FIG. 7 illustrates a club head 102 that includes a viewing opening 414. The viewing opening 414 may extend along the rear portion of the club head 102 closest to the hosel area 402 and the shaft 102. The viewing opening 414 may allow the user to view an angle indicator on the adjustment ring 300 or alternatively, the indicator 222 on the second end 204 of the hosel assembly 200.

Connection of the hosel assembly 200 (optionally with a shaft 106 already engaged with it) to the club head 102 will be described in more detail as illustrated in FIGS. 3 through 8C. As shown, the adjustment ring 300 may be inserted into the club head chamber 404 of the club head body 102 in an appropriate manner, such that at least one external rotation-inhibiting structure 224 of the adjustment ring 300 aligns with and engages the rotation-inhibiting structure 412 of the club head chamber 404 (as illustrated in FIGS. 8A through 8C). Additionally, the second end 204 of the hosel assembly 200 may be inserted into the adjustment ring 300 and the club head chamber 404 in an appropriate manner such that the rotation-inhibiting structures 206 of the hosel assembly 200 engage the internal rotation-inhibiting structures 226 of the sleeve insert 300. At this location and in this arrangement, the second end 206 of the hosel assembly 200 and the adjustment ring 300 are seated against the mounting plate 410. Additionally, the expanded portion 318 of the hosel assembly 200 is located adjacent to and/or seated against the top surface of the hosel area 402.

Once inserted, the hosel assembly 200 and the adjustment ring 300 may be engaged and secured with the club head body 102 by inserting the securing member or bolt member 400 through the opening 406 in the sole of the club head 102, through the opening 302 of the adjustment ring 300, and engaging the securing member 400 with the securing structure 210 provided with the hosel assembly 200. If desired, the locations where the adjustment ring 300 meets the club head 102 (e.g., at mounting plate 410 and/or the hosel opening) and/or where the securing member 400 meets the club head 102 (e.g., at the mounting plate 410) may include a flexible material (such as a washer, a gasket, an o-ring, an elastomeric washer or coating, etc.) to take up any extra space and to provide noise and/or vibration dampening, etc. This illustrated connection system is readily releasable, e.g., by twisting out the bolt member 400, to allow users to release the hosel assembly 200 and dial the adjustment ring 300 to a desired setting, thereby changing the face angle of the club head while not changing the lie angle or loft angle. FIGS. 8A through 8C specifically show how the adjustment ring 300 may be dialed or rotated within the hosel assembly 200.

If desired, the securing member 400 and mounting plate opening 410A may be structured so as to prevent the securing member 400 from completely falling out of the opening 406 when the securing member 400 is released from the hosel assembly 200 (e.g., by providing an enlarged ring on the free end of securing member 400). The securing member 400 may include a head having structures for engaging a screwdriver, an allen wrench, or another tool.

The above structure describes a releasable golf club head/shaft connection that provides a single angle adjustment of the face angle of the golf club head. To adjust the face angle of the club head 102 of the example structure as described above, the securing member 400 is removed from the club head body 102 and the hosel assembly 200. Next, the hosel assembly 200 and shaft 106 is removed from the club head 102 and the club head chamber 404. The adjustment ring 300 may then be rotated to the desired face angle settings as provided in the viewing area 414 or as provided on the adjustment ring 300 or the hosel assembly 200. In one example structure according to this invention, the desired face angle settings may include: 2-degrees open face angle, 1-degree open face angle, neutral, 1-degree closed face angle, and 2-degrees closed face angle. Other desired face angle settings may be utilized without departing from this invention. After the face angle is adjusted to the desired settings, the hosel assembly 200 is re-assembled into the club head 102 and the club head chamber 404 with the securing member 400 engaging the securing structure 210 provided with the hosel assembly 200. This process may be repeated to adjust the desired face angle settings again if desired.

Various releasable golf club head/shaft connections are known in the art and are commercially available. Most such connection systems, however, provide a single angle adjustment and do not have the capability to provide an independent adjustment to one of the lie angle and/or the face angle. For example, with a single angle adjustment, when the shaft is rotated with respect to the club head, the lie angle and the face angle may both possibly be adjusted. In the present invention, as described above, with a single rotational adjustment of the adjustment ring 300 within the club head chamber 404, the face angle can be changed without affecting the lie angle or the loft angle.

As will be described below, at least some example structures according to the present invention provide a second and independent adjustment to provide the capability to have independent control over adjusting the lie angle and/or the face angle. The second independent adjustment to the lie angle can be provided by including a set of sleeve inserts 260 with the releasable connection assembly or a set of angled washers 280 with the releasable connection assembly. The set of sleeve inserts 260 and the set of angled washers 280 will be described below. The set of sleeve inserts 260 and/or the set of angled washers 280 may be used with and in conjunction with the structures described above and illustrated in FIGS. 9 through 14C, to provide a second and independent adjustment to the lie angle.

Figure 9:
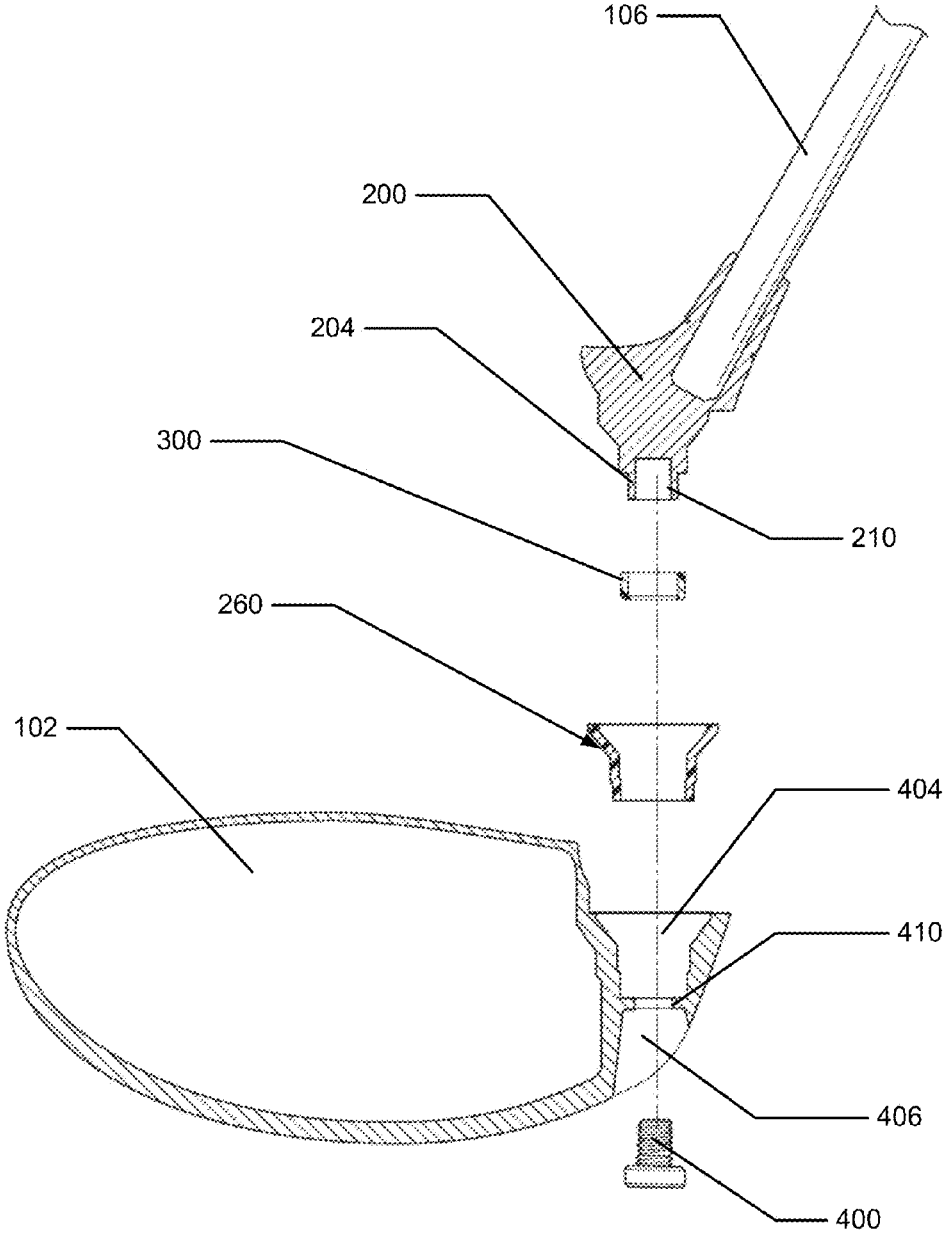
FIG. 9 illustrates an exploded section view of another example golf club head in accordance with this invention.
Figure 10A:
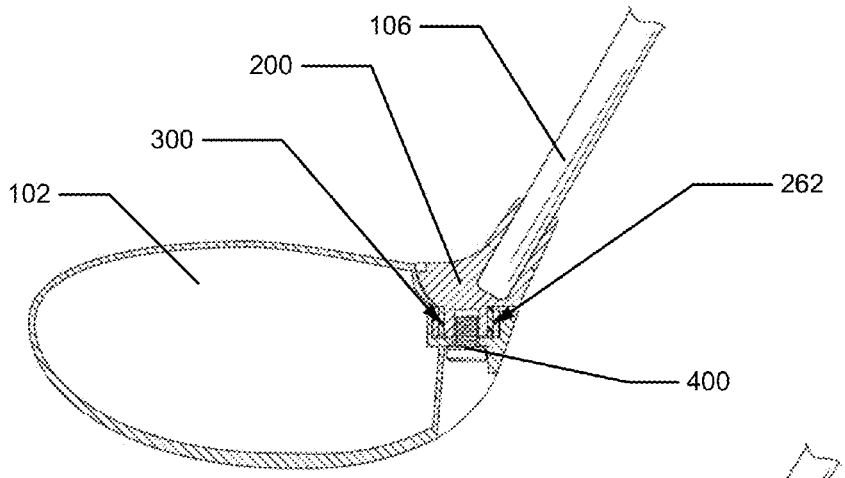
FIGS. 10A through 10C illustrate assembled section views of the golf club head illustrated in FIG. 9 in accordance with this invention.
Figure 10B:
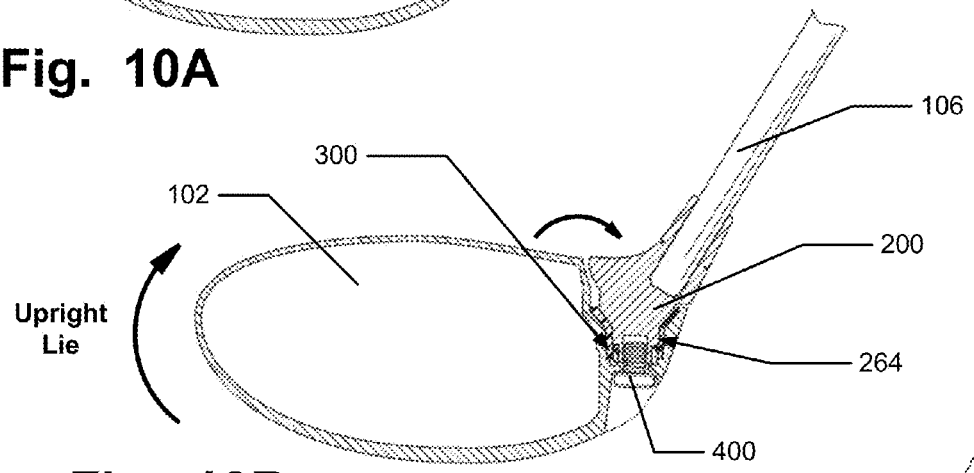
Figure 10C:
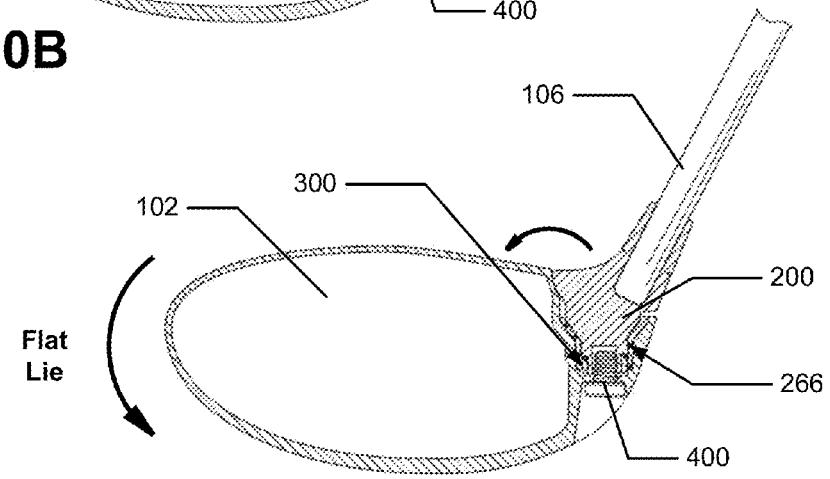

FIGS. 9 through 10C illustrate the use of a set of sleeve inserts 260 for an example releasable connection system in accordance with this invention. FIG. 9 illustrates an exploded section view of the example golf club head with a releasable connection system using a set of sleeve inserts 260. FIGS. 10A through 10C illustrate assembled section views of the golf club head with the example releasable connection system.

In one example, without departing from the present invention, the set of sleeve inserts 260 may include a neutral sleeve 262, a 2-degree flat lie sleeve 264, and a 2-degree upright lie sleeve 264. Additionally, sleeve inserts with different lie angle configurations may be utilized without departing from this invention. FIG. 10A illustrates an example releasable connection system with a neutral sleeve insert 262. FIG. 10B illustrates an example releaseable connection system with a 2-degree upright lie angle sleeve insert 264. FIG. 10C illustrates an example releaseable connection system with a 2-degree flat lie angle sleeve insert 266. The exterior portion of the sleeve inserts 260 may be generally cylindrical in shape, thereby being capable of fitting into and engaging the interior of the club head chamber 404. The interior of the sleeve inserts 260 may also be generally cylindrical in shape, thereby being capable of accepting and engaging the hosel assembly 200 and the adjustment ring 300. Additionally, the sleeve inserts 260 must be non-rotational within the club head chamber 404 as well as non-rotational with respect to the hosel assembly 200 and the adjustment ring 300. As was described above, any non-rotational means may be utilized with the sleeve inserts 260 without departing from this invention, to include a key or timing slot, a tooth, multiple teeth, splines, or flat-sided cross-sections. Generally, the set of sleeve inserts 260 are each designed to adjust the location of the hosel assembly 200 within the club head chamber 404, thereby adjusting the lie angle of the club head 102.

Connection of the hosel assembly 200 (optionally with a shaft 106 already engaged with it) to the club head 102 with the sleeve insert 260 will be described in more detail in conjunction with FIGS. 9 through 10C. As illustrated, a sleeve insert 260 may be inserted into the club head chamber 404 of the club head body 102 in an appropriate manner, such that the exterior portion of the sleeve insert 260 aligns with and engages the club head chamber 404. Additionally, the adjustment ring 300 may be inserted into the club head chamber 404 of the club head body 102 or the internal portion of the sleeve insert 260 in an appropriate manner, such that at least one rotation-inhibiting structure of the adjustment ring 300 aligns with and engages the internal portion of the sleeve insert 260 and/or the club head chamber 404. Additionally, the second end 204 of the hosel assembly 200 may be inserted into the adjustment ring 300, the sleeve insert 260, and the club head chamber 404 in an appropriate manner such that the rotation-inhibiting structures of the hosel assembly 200 engage the internal rotation-inhibiting structures of the adjustment ring 300. At this location and in this arrangement, the second end 204 of the hosel assembly 200 and the adjustment ring 300 may be seated against the mounting plate 410.

Once inserted, the sleeve insert 260, the hosel assembly 200, and the adjustment ring 300 may be engaged and secured with the club head body 102 by inserting the securing member or bolt member 400 through the opening 406 in the sole of the club head 102, through the adjustment ring 300, and engaging the securing member 400 with the securing structure 210 provided with the hosel assembly 200. If desired, the locations where the adjustment ring 300 meets the club head 102 (e.g., at mounting plate 410 and/or the hosel opening) and/or where the securing member 400 meets the club head 102 (e.g., at the mounting plate 410) may include a flexible material (such as a washer, a gasket, an o-ring, an elastomeric washer or coating, etc.) to take up any extra space and to provide noise and/or vibration dampening, etc. This illustrated connection system is readily releasable, e.g., by twisting out the bolt member 400, to allow users to release the hosel assembly 200. Once the hosel assembly is released, the users may change the sleeve insert 260 to a desired sleeve (e.g., neutral sleeve 262, upright lie angle sleeve 264, flat lie angle sleeve 266), thereby changing the lie angle of the club head while not changing the face angle or loft angle. Additionally, the user may also dial the adjustment ring 300 to a desired setting, thereby changing the face angle of the club head while not changing the lie angle or loft angle.

The set of sleeve inserts 260 may be made from any desired materials and from any desired number of independent parts without departing from this invention. In this illustrated example, the entire sleeve insert 260 is made as a unitary, one-piece construction from conventional materials, such as metals or metal alloys, plastics, and the like. In at least some example structures according to this invention, the sleeve insert 260 will be made from a titanium, aluminum, magnesium, steel, or other metal or metal alloy material. The various holes and/or surface structures may be produced in the material in any desired manner without departing from the invention, including via production methods that are commonly known and used in the art, such as by drilling tapping, machining, lathing, extruding, grinding, casting, extruding, molding, etc.

The above structure describes a releasable golf club head/shaft connection that provides an independent angle adjustment of the face angle of the golf club head and an independent angle adjustment of the lie angle. The adjustment of the face angle of the club head 102 was described previously. To adjust the lie angle of the club head 102 of the example structure as described above, the securing member 400 is removed from the club head body 102 and the hosel assembly 200. Next, the hosel assembly 200, shaft 106, and adjustment ring 300 is removed from the club head 102 and the club head chamber 404. For example, the neutral sleeve insert 262 may then be removed and replaced with the 2-degree upright lie angle sleeve insert 264, thereby creating a 2-degree upright lie angle for the club head 102. In one example structure according to this invention, the desired lie angle settings may include: a neutral sleeve insert 262 (as illustrated in FIG. 10A), a 2-degree upright lie angle sleeve insert 264 (as illustrated in FIG. 10B), and a 2-degree flat lie angle sleeve insert 266 (as illustrated in FIG. 10C). Other desired lie angle settings may be utilized without departing from this invention by utilizing different sleeve inserts or additional sleeve inserts. After the lie angle is adjusted by inserting the desired sleeve insert, the hosel assembly 200 and the adjustment ring 300 is re-assembled into the club head 102 and the club head chamber 404 with the securing member 400 engaging the securing structure 210 provided with the hosel assembly 200. This process may be repeated to adjust the desired lie angle settings again if desired.

Figure 11:
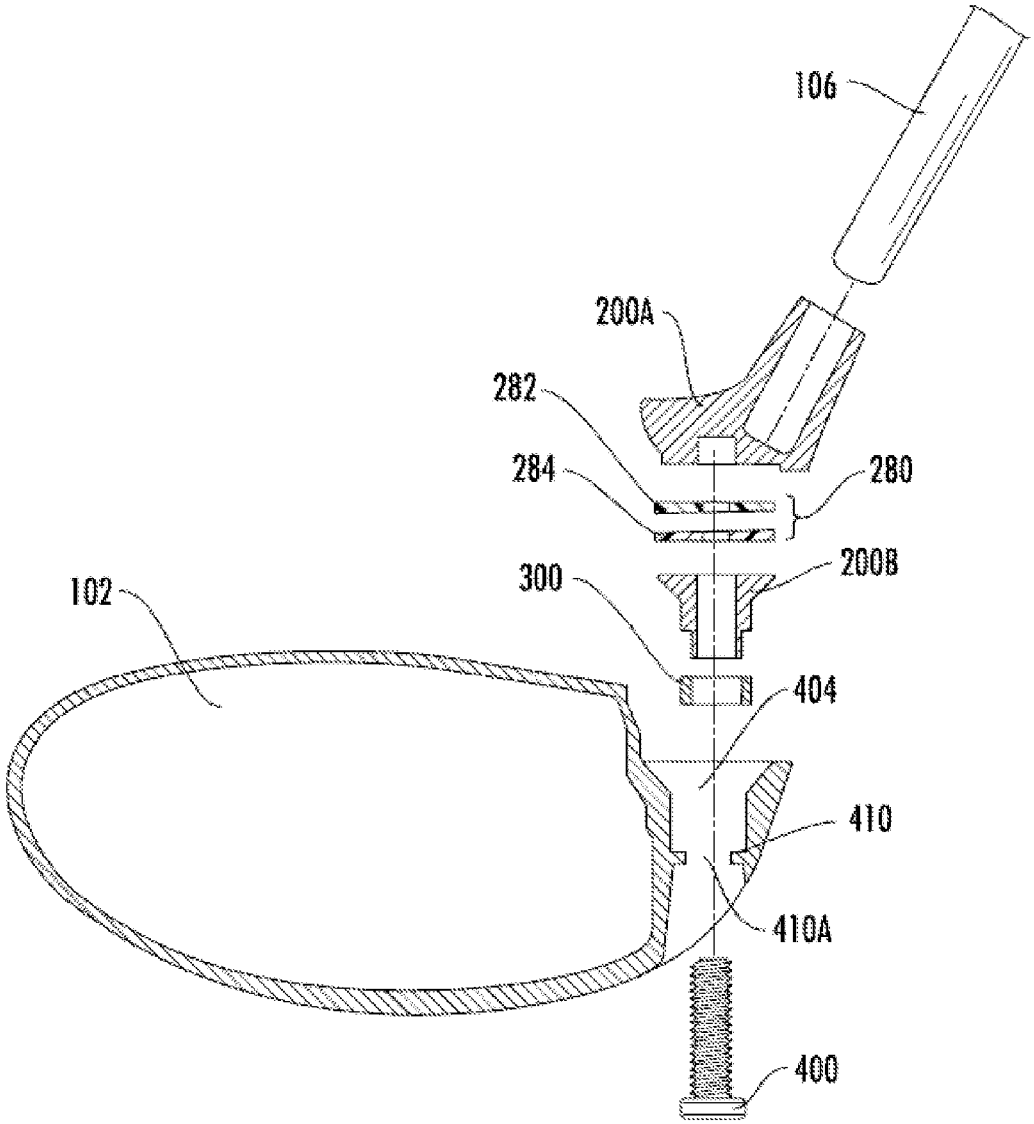
FIG. 11 illustrates an exploded section view of another example golf club head in accordance with this invention.
Figure 12A:
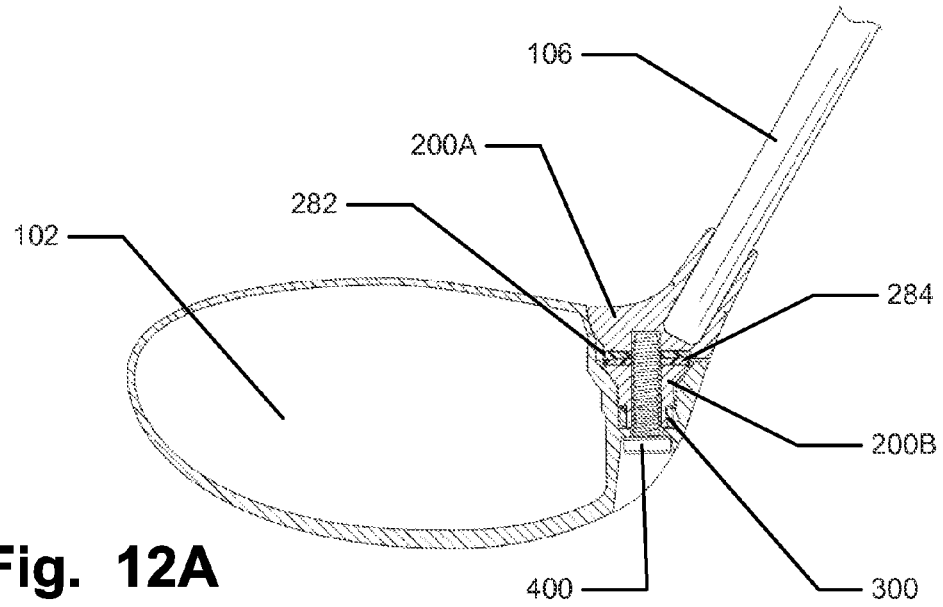
FIG. 12A illustrates an assembled section view of the example golf club head illustrated in FIG. 11 in accordance with this invention.
Figure 13:
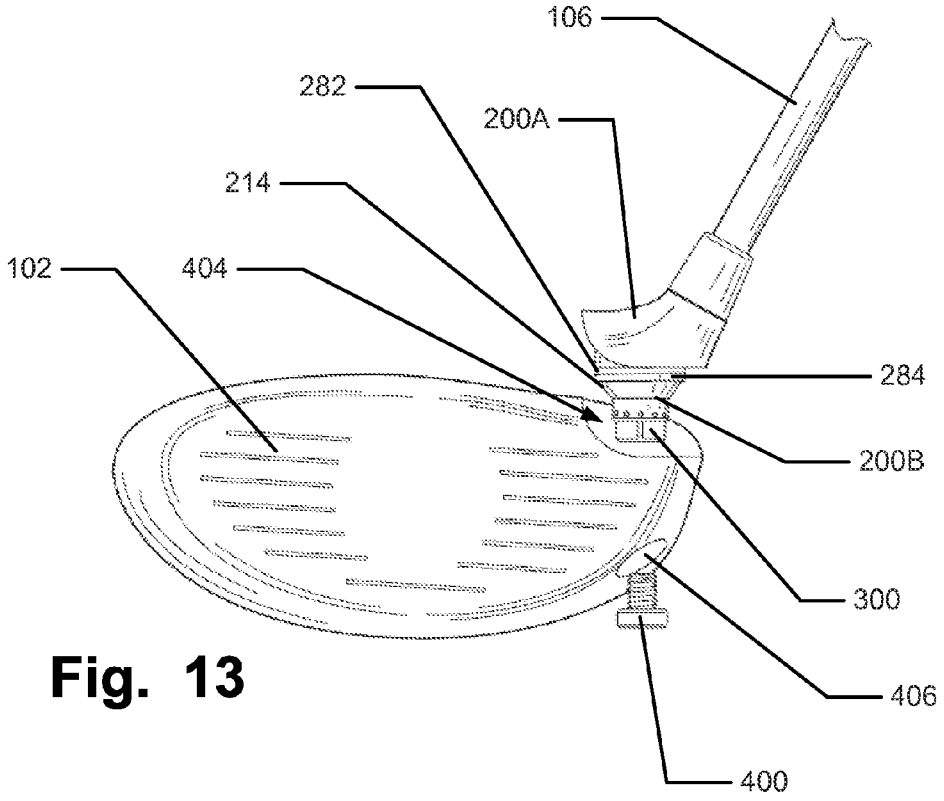
FIG. 13 illustrates an exploded front view of the example golf club head illustrated in FIG. 11 in accordance with this invention.
Figure 12B:
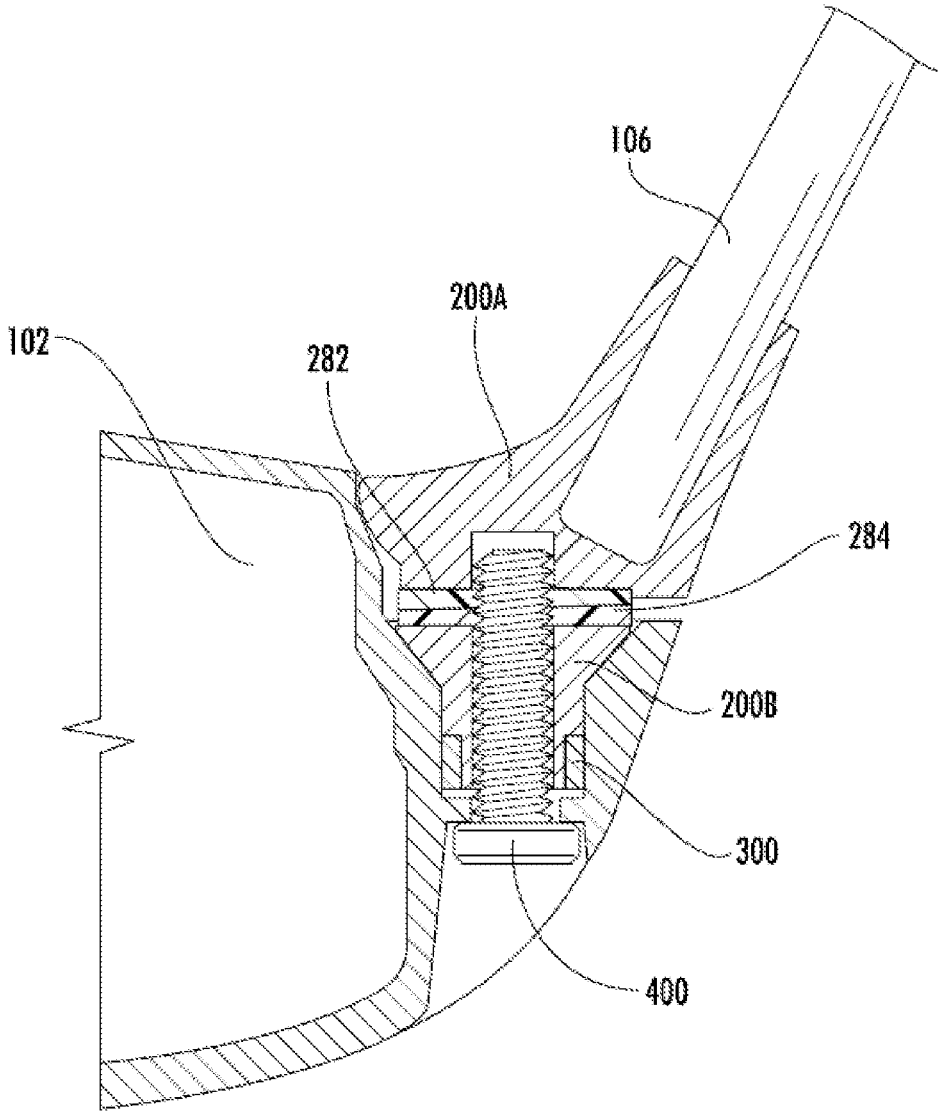
FIG. 12B illustrates a close-up view of the assembled section view in FIG. 12A of the example golf club head illustrated in FIG. 11 in accordance with this invention.

Additionally, instead of using the set of sleeve inserts 260 as described above, a set of angled washers 280 may provide the second independent adjustment of the lie angle. FIGS. 11 through 14D illustrate the use of a set of angled washers 280 for an example releasable connection system in accordance with this invention. Specifically, FIG. 11 illustrates an exploded section view of a golf club head of another example connection assembly. FIGS. 12A and 12B illustrate assembled section views of the example golf club head. FIG. 13 illustrates an exploded front view of the example golf club head. FIGS. 14A through 14D illustrate examples of the angled washers from the example golf club head.

The set of angled washers 280 of this example structure 104 is in the shape of a circular washer. The set of angled washers 280 may be other shapes without departing from this invention. The set of angled washers 280 may include a first angled washer 282 and a second angled washer 284. Each of the angled washers defines an opening 286 for receiving the securing member 400. Generally, the opening 286 is sized such that the securing member 400 is able to freely pass through the opening 286 to engage the threaded portion of the hosel assembly 200.

Figure 14A:
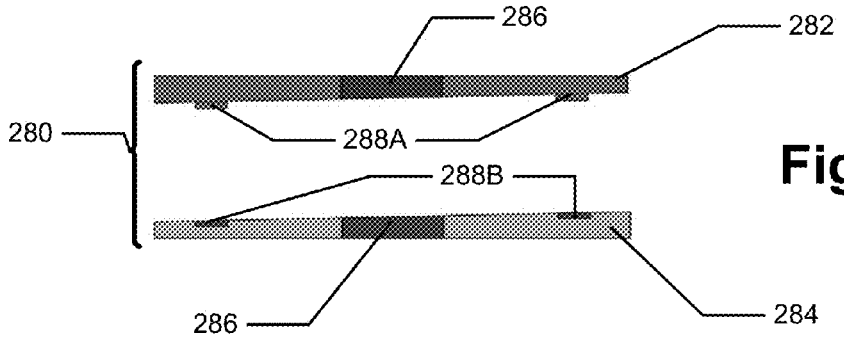
FIGS. 14A through 14D illustrate examples of the angled washers from the example golf club head illustrated in FIG. 11 in accordance with this invention.

Additionally, as illustrated in FIG. 14A, the set of angled washers 280 may include engaging structures 288, such that the first angled washer 282 can be engaged with the second angled washer 284 creating a stack of washers or a washer stack. The set of angled washers 280 of this example structure 104 have engaging structures 288 in the form of tabs 288A and slots 288B. The first angled washer 282 has a pair of tabs 288A that match a pair of slots 288B on the second angled washer 284. Other engaging structures 288 are possible without departing from this invention.

Figure 14B:
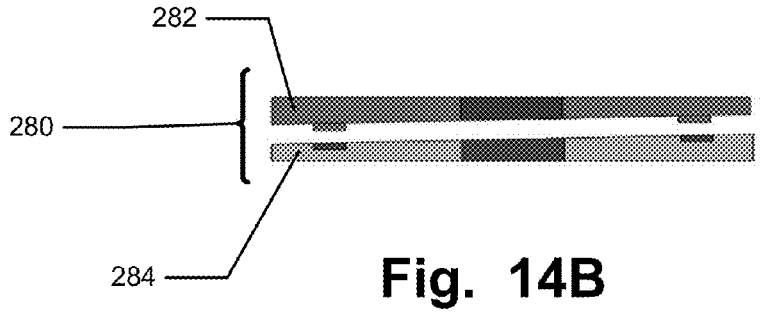
Figure 14C:
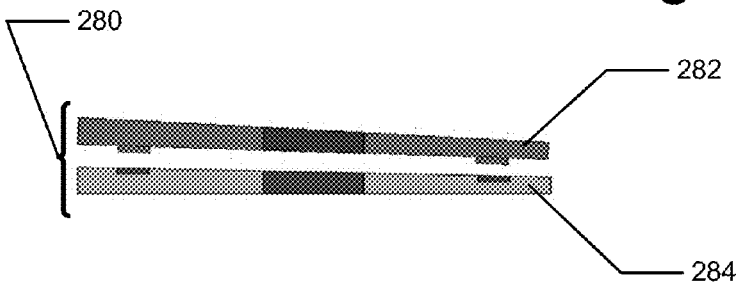
Figure 14D:
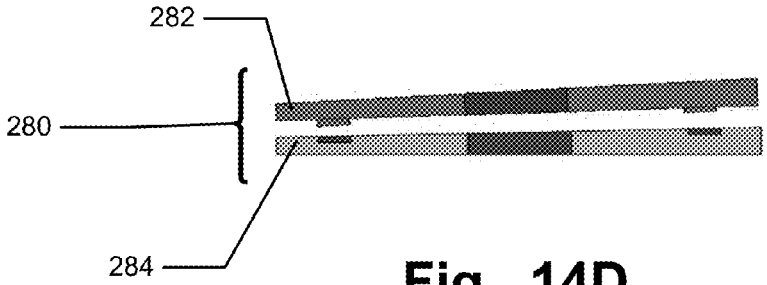

Additionally, the engaging structures 288 allow the washers 280 to be engaged in one of three positions, corresponding to a lie angle washer stack. As illustrated in FIG. 14B, a first position may be a neutral lie angle washer stack with the first washer 282 not rotated and the second washer 284 not rotated, thereby not changing the lie angle of the club head. As illustrated in FIG. 14C, a second position may be an upright lie angle stack with the first washer 282 rotated 180 degrees and the second washer 284 not rotated, thereby creating an upright lie angle of the club head 102. As illustrated in FIG. 14D, a third position may be a flat lie angle stack with the first washer 282 not rotated and the second washer 284 rotated 180 degrees, thereby creating a flat lie angle of the club head 102. Additionally, a set of washers 280 may have a given lie angle adjustment based on the angle between the two different washers 282 284. For example, the set of washers 280 may be designed to adjust the lie angle by 1 degree or 2 degrees or even 4 degrees. For a set of washers 280 with a 2 degree setting, the adjustable lie angle settings would be neutral lie angle, 2 degree flat lie angle, and 2 degree upright lie angle.

As illustrated, a set of angled washers 280 may be engaged together to form the desired lie angle setting for the club head. The set of angled washers 280 may then be inserted in between a top portion of the hosel assembly 200A and a bottom portion of the hosel assembly 200B. The hosel assembly 200 (to include the top portion 200A and the bottom portion 200B), the set of washers 280, and the adjustment ring 300 may be inserted into the club head chamber 404 of the club head body 102 in an appropriate manner, such that at least one external rotation-inhibiting structure of the adjustment ring 300 aligns with and engages the club head chamber 404. At this location and in this arrangement, the second end 204 of the hosel assembly 200 and the adjustment ring 300 may be seated against the mounting plate 410.

Once inserted, the hosel assembly 200 and the adjustment ring 300 may be engaged and secured with the club head body 102 by inserting the securing member or bolt member 400 through the opening 406 in the sole of the club head 102, through the adjustment ring 300, and engaging the securing member 400 with the securing structure 210 provided with the hosel assembly 200. This illustrated connection system is readily releasable, e.g., by twisting out the bolt member 400, to allow users to release the hosel assembly 200. Once the hosel assembly is released, the users may rotate the angled washers 280, thereby changing the lie angle of the club head 102 while not changing the face angle or loft angle. Additionally, the user may also dial the adjustment ring 300 to a desired setting, thereby changing the face angle of the club head while not changing the lie angle or loft angle.

The set of washers 280 may be made from any desired materials and from any desired number of independent parts without departing from this invention. In this illustrated example, the entire washer 280 is made as a unitary, one-piece construction from conventional materials, such as metals or metal alloys, plastics, and the like. In at least some example structures according to this invention, the washers 280 will be made from a titanium, aluminum, magnesium, steel, or other metal or metal alloy material. The various holes (e.g., opening 286) and or surface structures (e.g., tabs 288A and slots 288B) may be produced in the material in any desired manner without departing from the invention, including via production methods that are commonly known and used in the art, such as by drilling tapping, machining, lathing, extruding, grinding, casting, extruding, molding, etc.

The above structure as illustrated in FIGS. 11 through 14D describes a releasable golf club head/shaft connection that provides an independent angle adjustment of the face angle of the golf club head and an independent angle adjustment of the lie angle. The adjustment of the face angle of the club head 102 was described previously. To adjust the lie angle of the club head 102 of the example structure as illustrated in FIGS. 11 through 14D and described above, the securing member 400 is removed from the club head body 102 and the hosel assembly 200. Next, the top portion of the hosel assembly 200A and the shaft 106 are removed from the club head 102 and the club head chamber 404, thereby exposing the angled washers. The first washer 282 or the second washer 284 may then be rotated in 180 degree increments to achieve the desired lie angle setting. After the lie angle is adjusted by rotating one of the angled washers 282 284, the top portion of the hosel assembly 200A is re-assembled into the club head 102 and the club head chamber 404 with the securing member 400 engaging the securing structure 210 provided with the hosel assembly 200. This process may be repeated to adjust the desired lie angle settings again if desired.

While the releasable connection 104 as described above includes both the sleeve insert 260 (or set of angled washers 280) and the adjustment ring 300, an example embodiment of this invention may include the above structure without the adjustment ring 300. Without the adjustment ring 300, the releasable connection 104 is thereby capable of having a single independent adjustment to the lie angle without affecting the face angle or loft angle.

Figure 15:
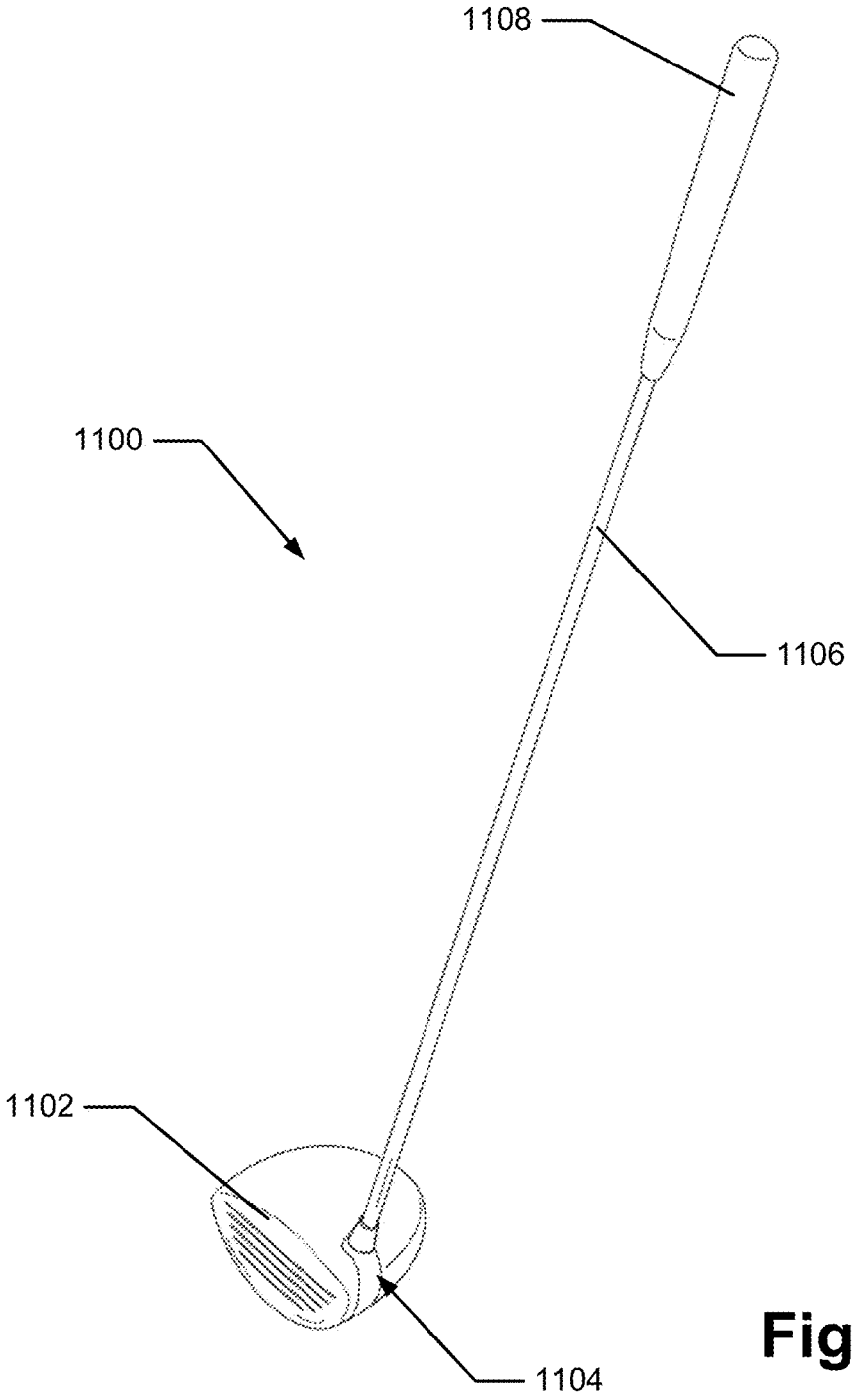
FIG. 15 generally illustrates a perspective front view of another example golf club according to this invention.

FIG. 15 generally illustrates another embodiment of an example golf club 1100 in accordance with at least some examples of this invention. This club 1100 includes a club head 1102, an adjustable club head/shaft connection region 1104 that connects the club head 1102 to a shaft 1106 (which will be described in more detail below), and a grip member 1108 engaged with the shaft 1106. While a driver/wood-type golf club head 1102 is illustrated in FIG. 15, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from conventional materials, in conventional constructions, in conventional manners, as are known and used in the art, optionally modified (if necessary, e.g., in size, shape, etc.) to accommodate the releasable club head/shaft connection parts.

Any desired materials also may be used for the shaft member 1106, including conventional materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 1108 may be engaged with the shaft 1106 in any desired manner, including in conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc.

Figure 16:
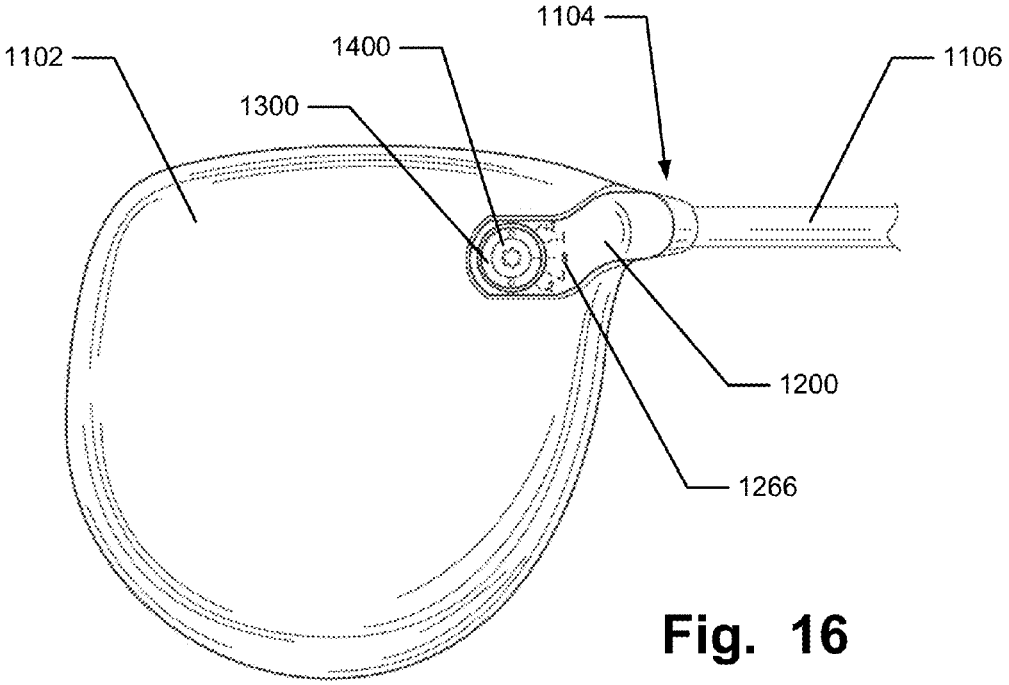
FIG. 16 illustrates a bottom view of the example golf club head illustrated in FIG. 15 in accordance with this invention.
Figure 17:
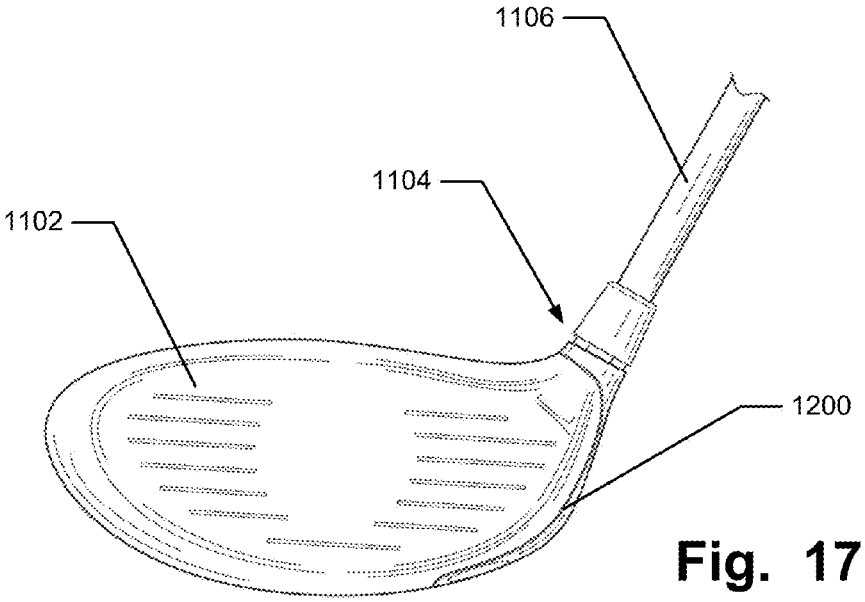
FIG. 17 illustrates an assembled front view of the example golf club head illustrated in FIG. 15 in accordance with this invention.
Figure 18:
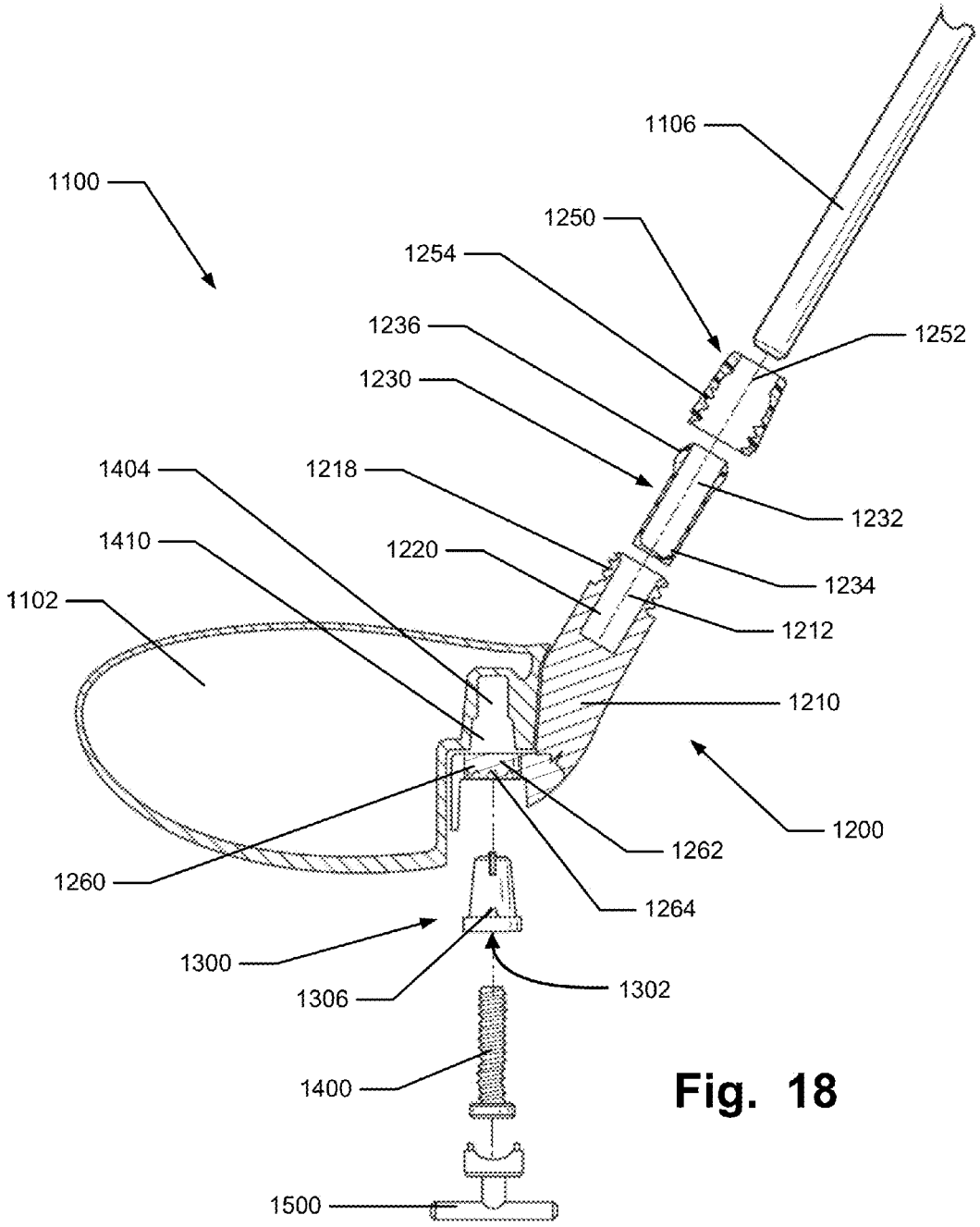
FIG. 18 illustrates an exploded sectional view of the example golf club head illustrated in FIG. 15 in accordance with this invention.
Figure 19:
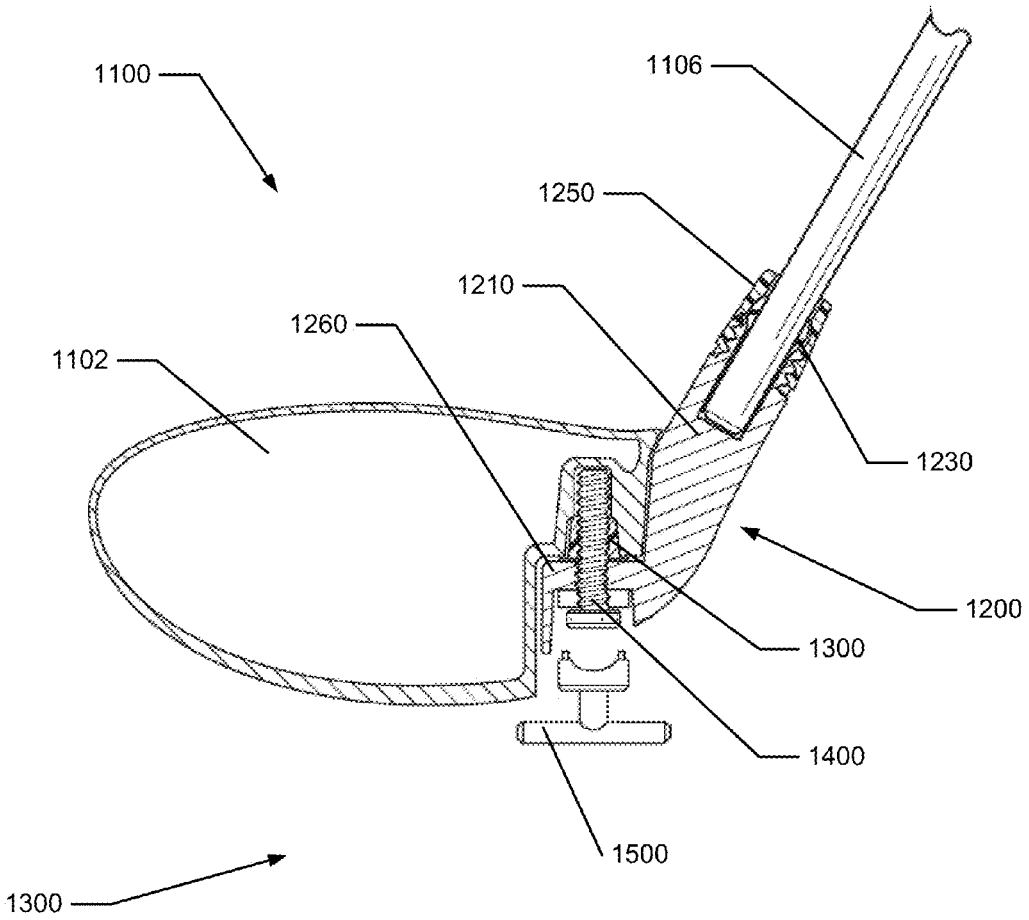
FIG. 19 illustrates an assembled sectional view of the example golf club head illustrated in FIG. 15 in accordance with this invention.
Figure 20:
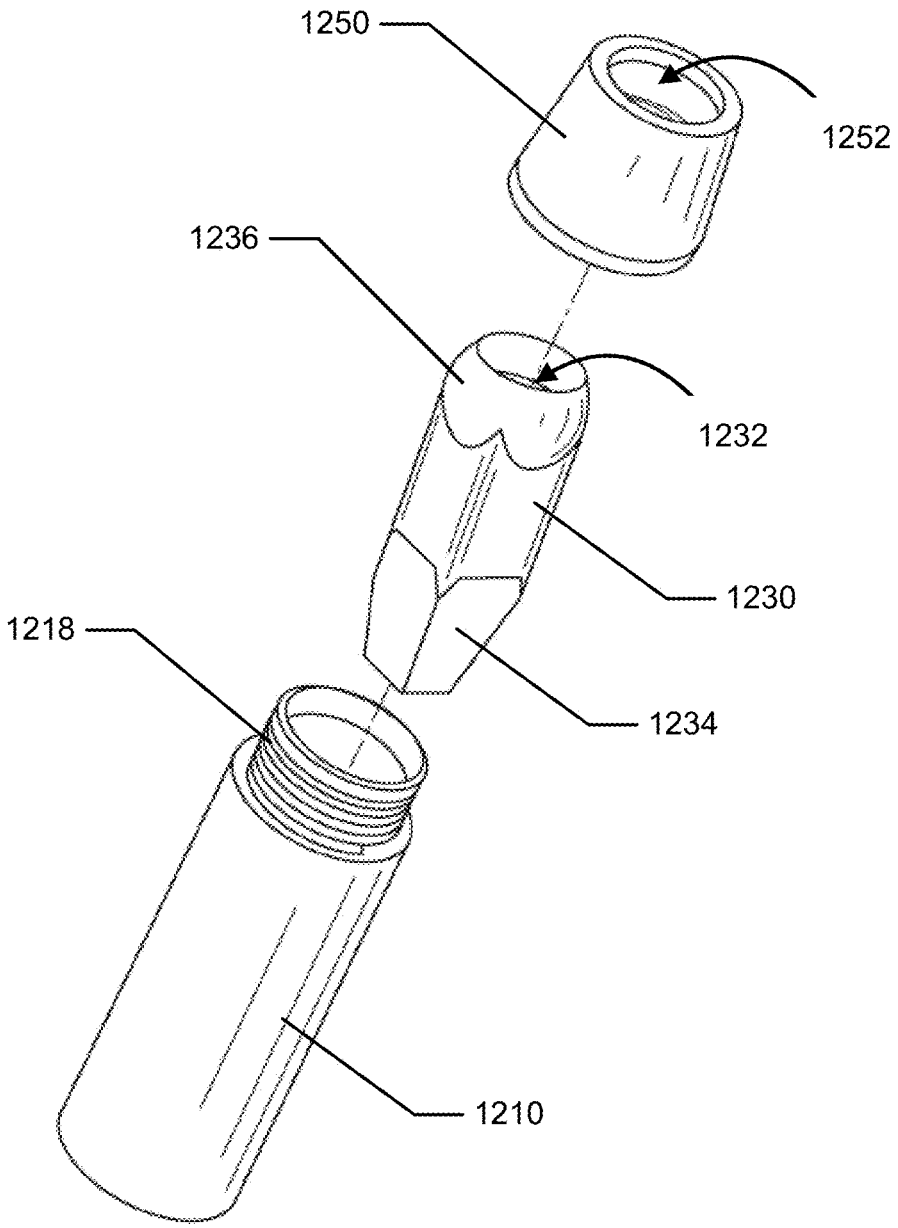
FIG. 20 illustrates an exploded perspective view of an example hosel assembly of the example golf club head illustrated in FIG. 15 in accordance with this invention.
Figure 21A:
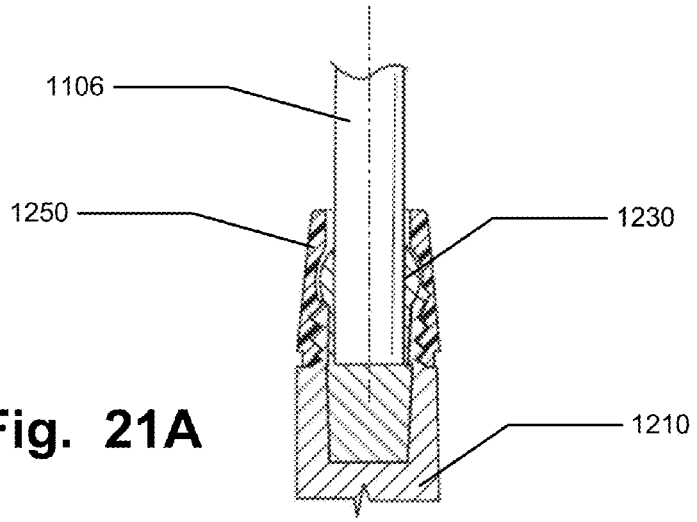
FIGS. 21A through 21C illustrate assembled sectional views of the example hosel assembly of the example golf club head illustrated in FIG. 15 in accordance with this invention.
Figure 21B:
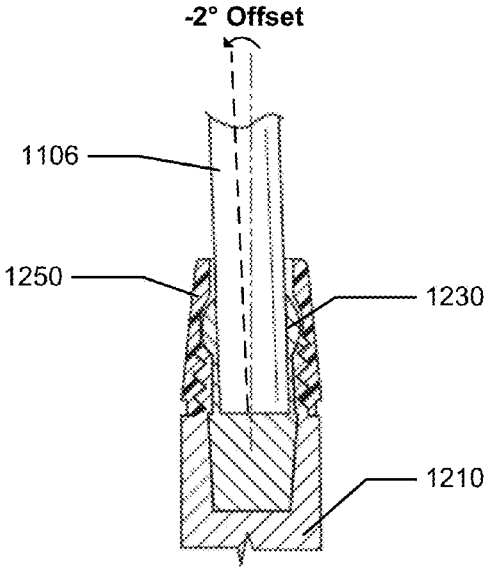
Figure 21C:
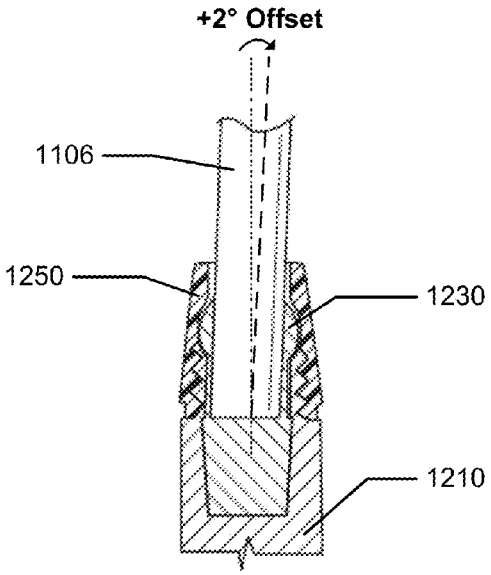

The adjustable connection 1104 between golf club heads and shafts in accordance with some examples of this invention now will be described in more detail in conjunction with FIGS. 16 through 22. FIG. 16 illustrates a bottom view of the example golf club head. FIG. 17 illustrates an assembled front view of the example golf club head. FIG. 18 illustrates an exploded sectional view of the example golf club head. FIG. 19 illustrates an assembled sectional view of the example golf club head. FIG. 20 illustrates an exploded perspective view of an example hosel assembly of the example golf club head. FIGS. 21A through 21C illustrate assembled sectional views of the example hosel assembly of the example golf club head.

Figure 22:
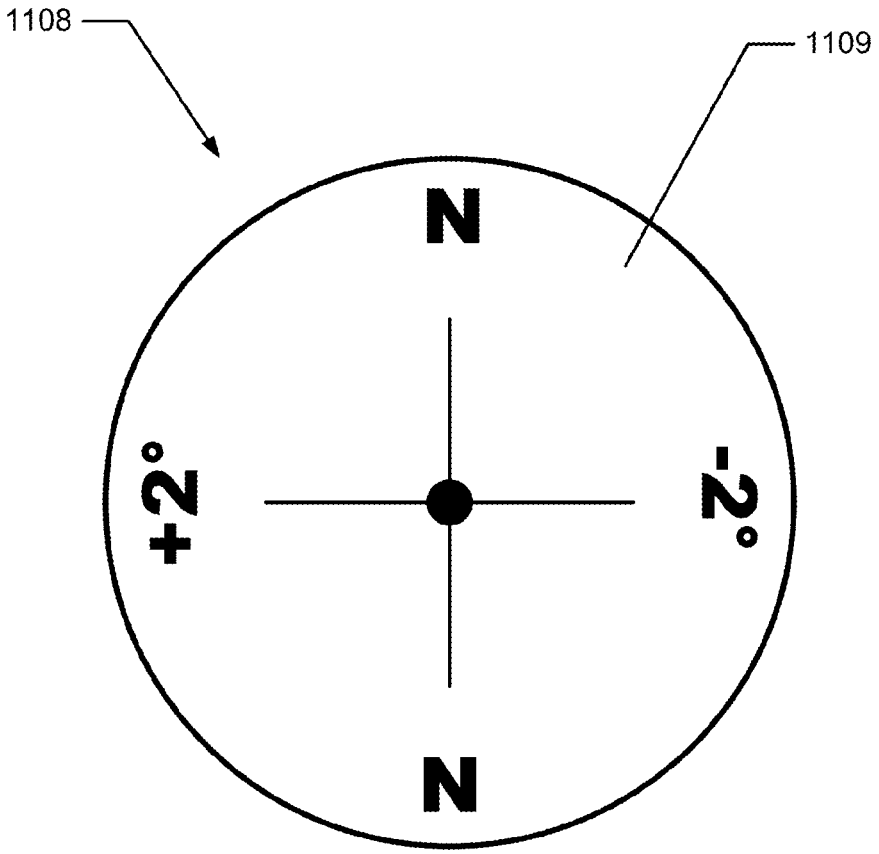
FIG. 22 illustrates a top view of a grip member of the example golf club illustrated in FIG. 15 in accordance with this invention.

FIG. 22 illustrates a top view of a grip member of the example golf club. As shown in these figures, this example adjustable connection 1104 includes three main parts, namely: a hosel assembly 1200, an adjustment member 1300, and a securing member 1400.

The hosel assembly 1200 includes a shaft engagement section 1210 and a club head engagement section 1260. The shaft engagement section 1210 may include a cylindrical chamber 1212 that may be sized to engage and fit over the shaft 1106 and may be secured thereto in any desired manner, e.g., via cements or adhesives; via welding, brazing, soldering, or other fusing techniques; via mechanical connectors; via a friction fit; etc. The club head engagement section 1260 may include structures to engage the club head near the sole or bottom of the club head 1102, thereby accepting a securing member to securely engage the hosel assembly 1200 to the club head 1102.

The various individual parts of this example structure 1104 will now be described in more detail as illustrated in FIGS. 18 through 22. In this example connection structure 1104, the shaft engagement section 1210 may include a shaft adapter 1230 and a securing member or compression nut 1250. The shaft engagement section 1210 may include a cylindrical-shaped (round) structure with an open threaded end 1218 and an adjacent interior cylindrical chamber 1212. The interior of the chamber 1212 may provide rotation-inhibiting structures 1220 (or side walls) that engage the rotation-inhibiting structures 1234 of the shaft adapter 1230. If desired, the rotation-inhibiting structures or side walls 1220 may be somewhat sloped (larger or wider toward the top of the interior chamber 1212 as compared to the bottom of the interior chamber 1212) to enable easier engagement/disengagement with the rotation-inhibiting structures 1234 of the shaft adapter 1230. The open threaded end 1218 of the hosel assembly 1200 may be sized and shaped so as to engage a shoulder structure 1236 on the shaft adapter 1230 and to help stably position the various parts of the connection structure 1104 with respect to one another.

FIGS. 18 through 20 provide a more detailed view of the shaft adapter 1230 of the hosel assembly 1200. As illustrated, the shaft adapter 1230 includes a shaft chamber 1232 for receiving the golf club shaft 1106. The shaft adapter 1230 also includes a rotation-inhibiting structure 1234. As described above, the rotation-inhibiting structure 1234 may be side walls or straight walls that are sized and shaped to engage with the correspondingly shaped rotation-inhibiting structure 1220 of the hosel assembly 1200 to thereby help prevent rotation of the shaft adapter 1230 with respect to the hosel assembly 1200 and the club head 1102. Like the rotation-inhibiting structure 1220 of the hosel assembly 1200, if desired, the rotation-inhibiting structure 1234 may have somewhat sloped side walls (larger or wider toward the top of the chamber 1232 as compared to the bottom of the chamber 1232) to enable easier engagement/disengagement with the rotation-inhibiting structures 1220 of the hosel assembly 1200. In the example structure 1104 illustrated in FIG. 20, the rotation-inhibiting structure 1234 (and corresponding rotation-inhibiting structures 1220 on the hosel assembly) has a four-sided polygonal cross-section, thereby allowing the shaft adapter 1230 and the shaft 1106 to rotate within the hosel assembly 1200 in four different positions. These positions and rotations will be described more below.

Alternatively, the rotation-inhibiting portions 1220 and 1234 may take on a variety of different structures, such as polygon structures having 12 sides or less, 8 sides or less, 6 sides or less, or even 4 sides or less. The rotation-inhibiting structures 1220 and 1234 need not exactly match each other, provided the structures engage some portion of the other structure so as to prevent undesired rotation of the shaft adapter 1230 with respect to the hosel assembly 1200 and club head 1102. Other rotation-inhibiting structures and arrangements also are possible without departing from this invention.

The securing member 1250 is illustrated in FIGS. 18 through 20. The securing member 1250 includes an opening 1252 sized and shaped so as to enable the securing member 1250 to freely slide along the free end of the shaft 1106. The interior of the securing member 1252 may include threads 1254 (or other securing structures) for engaging the threaded end 1218 provided on the hosel assembly 1200.

The connection structure 1104 also includes the club head engagement section 1260 as illustrated in FIGS. 18 and 19. The club head engagement section 1260 is sized and shaped to cooperatively fit against a rear portion of the club head 1102 and provides a strong base for securing the hosel assembly 1200 and the club head body 1102. In an embodiment of this invention, the club head engagement section 1260 fits within the rear portion of the club head 1102. The rear portion of the club head may be generally sized and shaped such that the hosel assembly 1200 and specifically the club head engagement section 1260 fits within the club head and still has enough tolerance to move slightly to allow the adjustability features of the club head 1102 (as will be described below).

The club head engagement section 1260 defines an opening 1262 for receiving the securing member 1400. Generally, the opening 1262 is sized such that the securing member 1400 is able to freely pass through the opening 1262 to engage the threaded chamber of the adjustment member 1300 or the club head chamber 1404. Alternatively, the securing member 1400 may also engage the club head engagement section 1260 at the opening 1262 (e.g., the opening 1262 may include threads that engage threads provided on the securing member 1400).

Additionally, the club head engagement section 1260 defines adjusting slots 1264. The adjusting slots 1264 are sized and shaped to cooperatively engage with the adjustment member 1300, and a rotation-inhibiting structure 1306 (an adjusting tab or key) on the adjustment member 1300 to thereby help prevent rotation of the adjustment member 1300 with respect to the club head 1102 and the hosel assembly 1100.

The hosel assembly 1200 may be made from any desired materials and from any desired number of independent parts without departing from this invention. In this illustrated example, the hosel assembly 1200 is made a multiple different parts (e.g., shaft engagement section 1210, shaft adapter 1230, securing nut 1250, and club head engagement section 1260). Each of these individual parts may be made as unitary, one-piece construction from conventional materials, such as metals or metal alloys, plastics, and the like. In at least some example structures according to this invention, the hosel assembly 1200 will be made from a titanium, aluminum, magnesium, steel, or other metal or metal alloy material. The various holes (e.g., interior chamber 1212, shaft chamber 1232, opening 1252, opening 1262) and/or surface structures (e.g., rotation-inhibiting structure 1234, adjusting slots 1264) may be produced in the material in any desired manner without departing from the invention, including via production methods that are commonly known and used in the art, such as by drilling tapping, machining, lathing, extruding, grinding, casting, extruding, molding, etc.

Additionally, as illustrated in FIGS. 18 and 19, the connection structure 1104 may also include an adjustment member 1300. The adjustment member 1300 may be generally cylindrical in shape. The adjustment member 1300 may define an opening 1302 for receiving the securing member 1400. Generally, the opening 1302 is sized such that the securing member 1400 is able to freely pass through the opening 1302 and through the adjustment member 1300. Additionally, the adjustment member 1300 may include threads 1304 located on the interior bore of the adjustment member 1300. The threads may be provided to engage threads provided on the securing member 1400.

The adjustment member 1300 may also include an adjusting rotation-inhibiting structure 1306. The adjusting rotation-inhibiting structure 1306 may be in the form of a key, a tab, or a tooth, as illustrated in FIG. 18. Other adjusting rotation-inhibiting structures 1306 are possible without departing from this invention, such as multiple teeth, splines, flat-sided cross sections, etc. While a variety of rotation-inhibiting structures may be provided without departing from this invention, the adjusting rotation-inhibiting structure 1306 constitutes a tooth extending along the longitudinal axis of the exterior surface of the adjustment member 1300. The adjusting rotation-inhibiting structure 1306 of the adjustment member 1300 may prevent rotation of the adjustment member 1300 with respect to a member into which it is fit (e.g., the opening 1262 and/or the golf club head, as will be explained more below). A variety of non-rounded cross-sectional structures may be used for the rotation-inhibiting structure without departing from this invention.

The adjustment member 1300 may be made from any desired materials and from any desired number of independent parts without departing from this invention. In this illustrated example, the entire adjustment member 1300 is made as a unitary, one-piece construction from conventional materials, such as metals or metal alloys, plastics, and the like. In at least some example structures according to this invention, the adjustment member 1300 will be made from a titanium, aluminum, magnesium, steel, or other metal or metal alloy material. The various holes (e.g., opening 1302) and/or surface structures (e.g., rotation-inhibiting structure 1306) may be produced in the material in any desired manner without departing from the invention, including via production methods that are commonly known and used in the art, such as by drilling tapping, machining, lathing, extruding, grinding, casting, extruding, molding, etc.

Furthermore, the connection structure 1104 may include a securing member 1400 (e.g., a threaded bolt member) that helps secure the hosel assembly 1200 and the adjustment member 1300 to the club head body 1102, as will be described in more detail below. In this example structure, a tool 1500 may be utilized to screw and tighten the threaded bolt member 1400 through the adjustment member 1300, the hosel assembly into the club head chamber 1404. The tool 1500 (or spike wrench for example) may include any corresponding structures to engage and tighten the threaded bolt member, such as multiple-pins, prongs, Phillips head, standard screwdriver, allen wrench, etc.

One example engagement of a golf club shaft 1106 with a club head 1102 utilizing the hosel assembly 1200 and the adjustment member 1300 will be described in more detail in conjunction with FIGS. 18 through 19. At some time during the head/shaft connection process, a shaft 1106 is engaged within the shaft chamber 1232 of the shaft adapter 1230. In this illustrated example structure, the shaft 1106 will be permanently engaged in the chamber 1232, e.g., via an adhesive or cement bond. Other ways of engaging a shaft 1106 with the shaft adapter 1230 are possible without departing from this invention, including, for example, mechanical connections (including releasable mechanical connections, such as threaded structures or the like); welding, brazing, soldering, or other fusing techniques; etc.

Once the shaft 1106 is connected to the shaft adapter 1230, the shaft adapter 1230 may be inserted into the hosel assembly 1200, and specifically the interior chamber 1212 of the shaft engagement section 1210. The securing member 1250 may then be rotatably engaged with the shaft engagement section 1210 of the hosel assembly 1200 by engaging the interior threads of the securing member 1250 with threaded end 1218 of the shaft engagement section 1210. Tightening the securing member 1250 to the shaft engagement section 1210 thereby secures the shaft adapter 1230 (and shaft 1106) in place for a snug and secure fit within the hosel assembly 1200.

Many variations in the connection system may be made from the specific structures described above without departing from this invention. For example, releasable securing systems other than threaded engagements of a securing member 1250 with the hosel assembly 1200 and/or the shaft adapter 1230 are possible without departing from this invention. For example, the securing member 1250 may include structures that extend into or otherwise engage the hosel assembly 1200 and/or the shaft adapter 1230 to thereby hold these members in place with respect to one another. As another example, if desired, the securing member 1250 may include slots, openings, or grooves that provide access to structures extending from the hosel assembly 1200 and/or the shaft adapter 1230 to thereby hold these members in place with respect to one another. As yet another example, if desired, the separate securing member 1250 may be omitted, e.g., if the hosel assembly 1200 and/or the shaft adapter 1230 directly include adequate structures to hold themselves in place with respect to one another. The securing member 1250 also may be integrally formed or connected with another part of the connection structure 1104, the club head 1102, and/or the shaft 1106.

The shaft 1106 and shaft adapter 1230 may be inserted rotatably into the interior chamber 1212 of the shaft engagement section 1210 and the hosel assembly 1200. In the example structure illustrated in FIGS. 20 through 21C, the shaft adapter 1230 may be inserted into the hosel assembly 1200 in four different configurations, one for each of the sides of the polygonal rotation-inhibiting structures 1220 and 1234. Furthermore, the shaft adapter 1230 may include an angled shaft chamber 1232, such that when the shaft adapter 1230 is rotatably engaged with the interior chamber 1212 of the shaft engagement section 1210 and the hosel assembly 1200, the shaft 1106 has a different offset with each rotation/configuration. As illustrated in FIG. 21A, the shaft adapter 1230 is inserted into the shaft engagement section 1210 with a neutral lie angle. As illustrated in FIG. 21B, the shaft adapter 1230 is inserted into the shaft engagement section 1210 with a negative 2-degree offset (−2° offset), thereby causing the lie angle of the golf club head to have a negative 2-degree lie angle. As illustrated in FIG. 21C, the shaft adapter 1230 is inserted into the shaft engagement section 1210 with a positive 2-degree offset (+2° offset), thereby causing the lie angle of the golf club head to have a positive 2-degree lie angle. Other desired lie angle settings may be utilized without departing from this invention.

The adjustment of the rotational position of the shaft adapter 1230 (and its attached shaft 1106) will be explained in more detail below in conjunction with FIGS. 21A through 21C. Changing the rotational position of the shaft adapter 1230 within the shaft engagement section 1210 of the hosel assembly 1200 may adjust one of various features of the overall golf club, namely the lie angle. To assist users to easily identify the club head's "settings" (e.g., the club head body 1102 position and/or orientation with respect to the shaft 1106), the end of the grip 1108 attached to the shaft 1106 may include markings or indicators. FIG. 22 shows an indicator 1109 on end of the grip 1108. By noting the relative position of the indicator, a club fitter or other user can readily determine and know the position of the shaft 1106 with respect to the club head body 1102 and its ball striking face. If desired, the indicator 1109 may be associated with and/or include specific quantitative information, such as a specifically identified lie angle as illustrated in FIG. 22. FIG. 22 illustrates an indicator 1109 showing an identification for: "N" or neutral lie angle, "+2°" or positive 2-degree offset lie angle, and "−2°" or negative 2-degree offset lie angle.

This shaft adapter 1230 is readily releasable, e.g., by twisting or releasing the securing member 1250 from the shaft engagement section 1210 of the hosel assembly 1200. This allows users to release the shaft adapter 1230 and rotate the shaft adapter 1230 (and shaft 1106) to a desired setting, thereby changing the lie angle of the club head while not changing the face angle or loft angle. FIGS. 21A through 21C specifically show the various positions/configurations of the shaft adapter 1230 within the shaft engagement section 1210 of the hosel assembly 1200. After the shaft adapter 1230 is reengaged with the shaft engagement section 1210 and the lie angle is adjusted to the desired settings, the shaft adapter 1230 is re-assembled into the shaft engagement section 1210 and the hosel assembly 1200 using the securing member 1250 and tightening the securing member 1250 to the shaft engagement section 1210 and the hosel assembly. This process may be repeated to adjust the desired lie angle settings again if desired.

The use of the adjustment member 1300 within the club head engagement section 1260 of the hosel assembly 1200 provides the ability to adjust the face angle of the club head, thereby providing a second independent adjustment to provide the capability to have independent control over adjusting the lie angle and/or the face angle.

One example engagement of the club head engagement section 1260 and the hosel assembly 1200 to a club head 1102 utilizing the adjustment member 1300 will be described in more detail as illustrated in FIGS. 18 and 19. At some time during the head/shaft connection process, as was described above, a shaft 1106 (with the shaft adapter 1230) is engaged within the hosel assembly 1200. Once the shaft 1106 and shaft adapter 1230 are connected to the hosel assembly 1200, the hosel assembly 1200 may be engaged with an adjustment member 1300 and mounted to a golf club head 1102. Alternatively, if desired, the shaft 1106 and shaft adapter 1230 may be connected to the hosel assembly 1200 later in the process, even as late as the final step in the connection process.

Connection of the hosel assembly 1200 and specifically the club head engagement section 1260 (optionally with a shaft 1106 already engaged with it) to the club head 1102 will be described in more detail in conjunction with FIGS. 18 and 19. As shown, club head engagement section 1260 fits within the rear area of the club head 1102, thereby lining up the opening 1262 with the club head chamber 1404. The adjustment member 1300 may then be inserted into the opening 1262 of the club head engagement section 1260 in an appropriate manner, such that at least one adjusting rotation-inhibiting structure 1306 of the adjustment member 1300 aligns with and engages the adjusting slots 1264 on the club head engagement section 1260. The adjustment member 1300 may extend at least partially into the club head chamber 1404 of the club head body 1102. At this location and in this arrangement, the adjustment member 1300 and club head engagement section 1210 are seated against the club head body 1102.

Once inserted, the adjustment member 1300 and the hosel assembly 1200 may be engaged and secured with the club head body 1102 by inserting the securing member or bolt member 1400 through the opening 1302 in the adjustment member 1300, through the opening 1262 of the club head engagement section 1260, and engaging the securing member 1400 with the securing structure 1410 provided within the club head chamber 1404. If desired, the locations where the club head engagement section 1360 meets the club head 1102, and/or, where the adjustment member 1300 meets the club head engagement section 1360, and/or where the securing member 1400 meets the adjustment member 1300 may include a flexible material (such as a washer, a gasket, an o-ring, an elastomeric washer or coating, etc.) to take up any extra space and to provide noise and/or vibration dampening, etc. This illustrated connection system is readily releasable, e.g., by loosening the bolt member 1400, to allow users to dial the adjustment member 1300 to a desired setting, thereby changing the face angle of the club head while not changing the lie angle or loft angle.

To adjust the face angle of the club head 1102 of the example structure as described above, the securing member 1400 is loosened from the club head body 1102 and the hosel assembly 1200. Using a tool 1500, the adjustment member 1300 may then be rotated or dialed to the desired face angle settings as provided on the indicator 1266 (illustrated in FIG. 16) as provided on the club head body 1102. When the adjustment member 1300 is rotated using the tool, the entire hosel assembly 1200 is thereby slightly rotated along a face angle plane. The rotation of the adjustment member 1300 and hosel assembly 1200 thus may create a change in the face angle of the club head 1102 with respect to the hosel assembly 1200 (and shaft 1106).

In one example structure according to this invention, the desired face angle settings may include: 2-degrees open face angle, 1-degree open face angle, neutral, 1-degree closed face angle, and 2-degrees closed face angle. Other desired face angle settings may be utilized without departing from this invention. After the face angle is adjusted to the desired settings, the hosel assembly 1200 is re-assembled into the club head 1102 with the securing member 1400 by re-tightening the securing member 1400, thereby indexing the club head 1102 to the new desired face angle and securing the hosel assembly 1200 to the club head 1102. This process may be repeated to adjust the desired face angle settings again if desired.

Additionally, the releasable adjustable connection assemblies may be used in any desired manner without departing from the invention. The clubs with such connection assemblies may be designed for use by the golfer in play (and optionally, if desired, the golfer may freely change the lie angle and face angle). As another example, if desired, clubs including releasable adjustable connections in accordance with the invention may be used as club fitting tools and when the desired combination of lie angles and face angles have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head/shaft connection assembly, comprising:

a hosel assembly including a first end and a second end opposite the first end, the first end including an open first end that defines an interior chamber for receiving a golf club shaft, and the second end including a cylindrical outer surface that defines a rotation inhibiting structure, wherein the second end of the hosel assembly is tapered to provide a smooth transition between the hosel assembly and a golf club head;

an adjustment member in the shape of a generally cylindrical ring, the adjustment member defines an exterior surface with an exterior rotation-inhibiting structure and an interior surface with an interior rotation-inhibiting structure, wherein the interior rotation inhibiting structure cooperatively engages with the rotation-inhibiting structure on the hosel assembly, and further wherein changing the rotational position of the adjustment member with respect to the hosel assembly provides independent adjustment of a face angle of a golf club head;

a pair of angled washers in the shape of a circular washer that include a first angled washer and a second angled washer when engaged together correspond to one of three lie angle washer positions defined as a neutral lie angle position, a upright lie angle position, and a flat lie angle position, thereby providing independent adjustment of a lie angle of a golf club head; and a securing system for releasably securing the adjustment member and the pair of angled washers with the hosel assembly.

2. A golf club head/shaft connection assembly according to claim 1, wherein the second end of the hosel assembly includes a cylindrical inner surface that engages a securing member of the securing system.

3. A golf club head/shaft connection assembly according to claim 2, wherein the cylindrical inner surface includes threads to engage to threads on the securing member.

4. A golf club head/shaft connection assembly according to claim 1, wherein the hosel assembly further includes an expanded portion that provides a stop that prevents the hosel assembly from extending into a golf club head and provides a strong base for securing the hosel assembly.

5. A golf club head/shaft connection assembly according to claim 1, wherein the adjustment member defines an opening sized such that a securing member of the securing system is able to freely pass through the opening to engage the hosel assembly.

6. A golf club head/shaft connection assembly according to claim 1, wherein the exterior rotation-inhibiting structure is defined by an exterior tooth extending along the longitudinal axis of the exterior surface of the adjustment member.

7. A golf club head/shaft connection assembly according to claim 6, wherein the exterior tooth engages a slot of an internal portion of a club head.

8. A golf club head/shaft connection assembly according to claim 1, wherein the interior rotation-inhibiting structure is defined by an interior tooth extending along the longitudinal axis of the interior surface of the adjustment member.

9. A golf club head/shaft connection assembly according to claim 1, wherein the neutral lie angle position is defined by the first washer not rotated and the second washer not rotated when engaged together, the upright lie angle position is defined by the first washer rotated 180 degrees and the second washer not rotated when engaged together, and the flat lie angle position is defined by the first washer not rotated and the second washer rotated 180 degrees when engaged together.

10. A golf club head/shaft connection assembly according to claim 1, wherein the first washer has a pair of tabs that engage a pair of slots on the second angled washer.

11. A golf club, comprising:

a shaft;

a golf club head that includes a hosel opening that provides access to a club head chamber defined in the club head;

a hosel assembly including a first end and a second end opposite the first end, the first end including an open first end that defines an interior chamber for receiving the shaft, and the second end including a cylindrical outer surface that defines a rotation inhibiting structure, wherein the second end of the hosel assembly is tapered to provide a smooth transition between the hosel assembly and the golf club head;

an adjustment member in the shape of a generally cylindrical ring, the adjustment member defining an exterior surface with an exterior rotation-inhibiting structure and an interior surface with an interior rotation-inhibiting structure, wherein the interior rotation inhibiting structure cooperatively engages with the rotation-inhibiting structure on the hosel assembly, and further wherein changing the rotational position of the adjustment member with respect to the hosel assembly provides independent adjustment of a face angle of the golf club head;

a pair of angled washers in the shape of a circular washer that include a first angled washer and a second angled washer when engaged together correspond to one of three lie angle washer positions defined as a neutral lie angle position, an upright lie angle position, and a flat lie angle position, thereby providing independent adjustment of a lie angle of the golf club head; and a securing system for releasably securing the adjustment member and the pair of angled washers with the hosel assembly.

12. A golf club according to claim 11, wherein the second end of the hosel assembly includes a cylindrical inner surface that engages a securing member of the securing system.

13. A golf club according to claim 12, wherein the cylindrical inner surface includes threads to engage to threads on the securing member.

14. A golf club according to claim 11, wherein the hosel assembly further includes an expanded portion that provides a stop that prevents the hosel assembly from extending into the golf club head and provides a strong base for securing the hosel assembly.

15. A golf club according to claim 11, wherein the adjustment member defines an opening sized such that a securing member of the securing system is able to freely pass through the opening to engage the hosel assembly.

16. A golf club according to claim 11, wherein the exterior rotation-inhibiting structure is defined by an exterior tooth extending along the longitudinal axis of the exterior surface of the adjustment member.

17. A golf club according to claim 16, wherein the exterior tooth engages a slot in the club head chamber.

18. A golf club according to claim 11, wherein the interior rotation-inhibiting structure is defined by an interior tooth extending along the longitudinal axis of the interior surface of the adjustment member.

19. A golf club according to claim 11, wherein the neutral lie angle position is defined by the first washer not rotated and the second washer not rotated when engaged together, and wherein the upright lie angle position is defined by the first washer rotated 180 degrees and the second washer not rotated when engaged together, and wherein flat lie angle position is defined by the first washer not rotated and the second washer rotated 180 degrees when engaged together.

20. A golf club according to claim 11, wherein the first washer has a pair of tabs that engage a pair of slots on the second angled washer.

* * * * *